US010733965B1

(12) United States Patent
Warner

(10) Patent No.: US 10,733,965 B1
(45) Date of Patent: Aug. 4, 2020

(54) STRINGED INSTRUMENT ENHANCED WITH SYMPATHETIC STRINGS

(71) Applicant: David Cody Warner, Las Vegas, NV (US)

(72) Inventor: David Cody Warner, Las Vegas, NV (US)

( * ) Notice: Subject to any disclaimer, the term of this patent is extended or adjusted under 35 U.S.C. 154(b) by 0 days.

(21) Appl. No.: 16/550,240

(22) Filed: Aug. 25, 2019

Related U.S. Application Data

(60) Provisional application No. 62/770,171, filed on Nov. 20, 2018, provisional application No. 62/722,898, filed on Aug. 25, 2018.

(51) Int. Cl.

| | |
|---|---|
| ***G10D 1/02*** | (2006.01) |
| ***G10D 3/10*** | (2006.01) |
| ***G10D 3/14*** | (2020.01) |
| ***G10D 3/02*** | (2006.01) |

(52) U.S. Cl.
CPC ..... *G10D 3/10* (2013.01); *G10D 1/02* (2013.01); *G10D 3/02* (2013.01); *G10D 3/14* (2013.01)

(58) Field of Classification Search
CPC .. G10D 3/10; G10D 1/02; G10D 3/02; G10D 3/14
See application file for complete search history.

(56) References Cited

U.S. PATENT DOCUMENTS

| | | | | | |
|---|---|---|---|---|---|
| 17,218 | A | * | 5/1857 | Hett | G10D 3/02 84/295 |
| 73,569 | A | * | 1/1868 | Bishop | G10D 1/02 84/274 |
| 158,116 | A | * | 12/1874 | Payne | G10D 1/02 84/274 |
| 419,625 | A | | 1/1890 | Barnard | |
| 465,490 | A | * | 12/1891 | Olson | G10D 3/02 84/295 |
| 532,622 | A | * | 1/1895 | Wollenhaupt | G10D 3/02 84/295 |
| 1,344,497 | A | | 6/1920 | Fleming | |
| 1,489,710 | A | * | 4/1924 | Olsen | G10D 3/02 84/295 |
| 1,513,159 | A | * | 10/1924 | Cremer | G10D 3/02 84/295 |
| 1,560,372 | A | * | 11/1925 | Berge | G10D 1/10 84/270 |

(Continued)

*Primary Examiner* — Robert W Horn
(74) *Attorney, Agent, or Firm* — Connie R. Masters

(57) ABSTRACT

A stringed instrument with sympathetic strings is provided that includes (in addition to the primary elements corresponding to standard instrument elements) sympathetic strings, one or more supplementary bridges, a supplementary string termination assembly, and a set of supplementary tuners. The sympathetic strings are stretched diagonally across the soundboard of the instrument, with one end of each string attached at a supplementary tuner and the other end attached at a supplementary string termination assembly. The sympathetic strings are spaced by the supplementary bridge(s) a sufficient distance from the soundboard to prevent interaction with it during vibration of the string during playing. The sympathetic strings are activated by sound vibrations created by the bowed primary strings, may additionally be activated by plucking or strumming, and may be manually muted.

20 Claims, 17 Drawing Sheets

(56) References Cited

U.S. PATENT DOCUMENTS

| | | | | | |
|---|---|---|---|---|---|
| 1,701,809 | A * | 2/1929 | Jerome | G10D 3/02 | 84/274 |
| 2,124,243 | A * | 7/1938 | Carter | G10D 1/02 | 84/274 |
| 2,741,937 | A * | 4/1956 | Auville | G10D 3/02 | 84/274 |
| 4,018,129 | A | 4/1977 | Hollander | | |
| 4,236,191 | A | 11/1980 | Martinez | | |
| 4,282,792 | A * | 8/1981 | Voorthuyzen | G10D 3/04 | 84/277 |
| 4,745,837 | A | 5/1988 | Rimsa | | |
| 5,131,307 | A | 7/1992 | Castillo | | |
| 6,284,957 | B1 | 9/2001 | Leguia | | |
| 7,288,706 | B2 * | 10/2007 | Gaffga | G10D 1/00 | 84/184 |
| 2003/0094087 | A1 | 5/2003 | Gregory | | |
| 2014/0109753 | A1 | 4/2014 | Ludwig | | |

* cited by examiner

STRINGED INSTRUMENT ENHANCED WITH SYMPATHETIC STRINGS

CROSS-REFERENCE TO RELATED APPLICATIONS

This nonprovisional application claims the benefit of U.S. Provisional Patent Application Ser. No. 62/722,898, filed on Aug. 25, 2018 and claims the benefit of U.S. Provisional Patent Application Ser. No. 62/770,171, filed on Nov. 20, 2018, which are incorporated herein in their entirety.

FIELD OF INVENTION

This invention relates generally to the technical field of stringed musical instruments, and, more particularly, to bowed string instruments augmented with sympathetic strings.

BACKGROUND OF THE INVENTION

Over the last few centuries in the musical sphere, there has been an interest in stringed instruments that include sympathetic strings. Many of these instruments have the sympathetic strings aligned with and underlying the standard strings; these aligned strings are often partially disposed within the instrument body. For example, a traditional Norwegian stringed instrument called the hardanger fiddle is essentially a violin with four standard strings plus four or five under-strings or sympathetic strings that resonate under the influence of the standard four strings. These additional strings are aligned with the standard strings and run from inside the neck to the outside the body above the instrument's soundboard. These under-strings are not accessible for plucking. Another example of an instrument with sympathetic strings is the Baroque voila d'amore that similarly has both standard bowed strings and additional strings that run at least partially outside the body of the instrument; they run under and are aligned with the bowed strings. A third example is the Indian sitar which has a long hollow neck, squat body, and six or seven plucked standard strings that run over the curved, raised frets along with aligned sympathetic strings that run underneath the frets to resonate in sympathy with the plucked strings. These stringed instruments with aligned strings do not allow a musician to readily pluck the sympathetic strings, thus restricting the musical sounds produced to resonant sounds.

A few instruments with sympathetic strings have sympathetic strings that are not aligned with and disposed under the primary strings. An example of this is the harp-guitar, which has harp-like strings attached to a second arm. The harp-guitar has both the standard guitar strings on the guitar neck and a set of harp-like strings positioned to the side of the standard strings but extending onto an arm that projects upward separate from the guitar neck, giving the appearance of a two-necked guitar. This second arm significantly changes the aesthetics and artistic design of the guitar. Not only might the harp-guitar design be considered unwieldly and/or awkward, but also it does not fit into any standard stringed instrument case.

Thus, though interest in stringed instruments with sympathetic strings has been demonstrated over the years, the proposed stringed instruments with sympathetic strings lack some advantageous features. Some do not position the sympathetic strings for plucking or strumming. Some present an awkward appearance. Some cannot fit into any conventional instrument case. A bowed instrument with sympathetic strings would provide advantages over these instruments by broadening the repertoire of sounds and acoustics of the instrument, which would provide benefits to both players and composers. Not only could an instrument with sympathetic strings deliver the standard sounds of the bowed strings, but it could provide a longer resonation than the standard bowed strings, and it could additionally provide the possibility of non-traditional plucking and strumming sounds. Plus, sympathetic strings positioned in an elegant, visually pleasing manner without disrupting the overall look of the stringed instrument would provide advantages in aesthetics and in in facilitating storage and transport in available cases. Accordingly, there is a need for a bowed instrument enhanced with sympathetic strings positioned efficiently and attractively.

BRIEF SUMMARY OF THE INVENTION

The present invention is directed to a stringed instrument, particularly a bowed stringed instrument (such as a cello, violin, viola, or bass) with sympathetic strings that are positioned to be plucked or strummed and that are disposed in an aesthetically pleasing design. The sympathetic string enhanced stringed instrument comprises primary elements corresponding to standard bowed stringed instrument elements plus sound-enhancing supplementary sympathetic strings (along with associated supplementary elements) for creating new, pleasing, and musically interesting sounds. The supplementary elements connect the sympathetic strings to the bowed stringed instrument and support them in the proper position to create the innovative sounds.

The primary bowed stringed instrument elements include a neck and body with the standard number of bowed primary strings stretching vertically from primary tuners at the top of the neck to a primary tailpiece disposed centrally on the lower bout of the body. For example, in a cello, the primary bowed strings, with pitches C, G, D, and A, are elevated from the cello soundboard by a nut portion of the peg box, a primary bridge, and a primary tailpiece. In the instant invention, in addition to the vertical primary bowed strings, multiple sympathetic strings are included that are oriented diagonally across the soundboard (the front panel or face) of the bowed stringed instrument.

Supplementary elements associated with these sympathetic strings include at least one supplementary bridge, a supplementary string termination assembly (such as a supplementary tailpiece(s), interior reinforcement, or other structure to which the strings are attached for termination), and a supplementary tuner for each sympathetic string.

The sympathetic strings are supported by the one or more supplementary bridges, which elevate the sympathetic strings a sufficient distance from the soundboard to allow them to vibrate without touching it (or at least substantially without touching it). One end of each sympathetic string is attached at a supplementary tuner, and the opposing end of each sympathetic string is attached at a supplementary string termination assembly. For example, in the first embodiment disclosing a cello enhanced with sympathetic strings, one end of each sympathetic string is attached at a supplementary tuner disposed on the left (player's right) upper bout of the cello and runs diagonally with the opposing end of each sympathetic string attached at a supplementary tailpiece disposed on the right (player's left) lower bout. In the violin variation of the third embodiment, the end of each sympathetic string is attached at a supplementary string termination assembly disposed on the left (player's right) upper bout of the violin and runs diagonally with the opposing end of each sympathetic string attached at a supplementary tuner disposed on the right (player's left) lower bout.

The sympathetic strings are activated by sound vibrations created by the primary bowed strings and may optionally and additionally be activated by plucking or strumming. Further, when desired, the sympathetic strings may be muted by the player's hand or other muting device.

The bowed string instrument enhanced with sympathetic strings is played with a bow like a regular instrument, but the range of sounds that can be produced is greatly improved—not only by the enriched resonance, but also by the ability to strum or pluck the sympathetic strings to add a harp-like or guitar-like sound. This versatility provides advantages in multiple venues. It may be especially advantageous in recording studio work because the sympathetic strings resonate significantly longer than the primary bowed strings of the instrument and continue ringing after the player has moved on to playing another note. In a recording setting, this effect, known as reverb, would normally be added later through editing. Having the instrument provide its own built-in reverb saves time and money during studio editing.

The bowed stringed instrument enhanced with sympathetic strings also has benefits in a live performance setting. The inherent, natural reverb created by the sympathetic strings creates the effect that the listener is in a large performance hall, even when the performance space has no natural acoustics. This enhances the listening experience of the audience and gives the illusion of being in a large acoustical performance hall when the performance is actually in a small intimate space.

Advantageously, the bowed stringed instrument with sympathetic strings can also create many sound effects that are not possible to create with a standard instrument and that would be difficult or even impossible to produce with post-production editing. With the sympathetic strings spread across the soundboard of the instrument, they can easily be plucked or strummed by the player. The unique sound possibilities of this instrument open up a new world of creative expression to artists and composers alike.

The instrument enhanced with sympathetic strings provides additional advantages from an educational perspective. For example, in the cello variation, there are preferably twelve sympathetic strings. With the twelve sympathetic strings tuned to all twelve pitches of a chromatic scale (a scale made up of all half steps), every pitch is represented. Thus, regardless of the key in which the musician is playing, there is equal resonance. However, the sympathetic strings only resonate if the musician plays the note on the primary bowed strings in tune. This functions to help train the musician's ear to hear very small differences in intonation. In addition, the fact that the previous notes are still ringing when the musician plays the subsequent notes helps train the ear to hear the spatial relationships between notes, further fine-tuning the musician's ear.

In addition to the inclusion of sympathetic strings, additional augmenting aspects are presented that serve to heighten the visual interest of the instrument, such as lights and fog.

In one aspect of the invention, the set of supplementary tuners are inset within an inset channel of the left upper bout with the stem of each tuner extending through the instrument soundboard.

In a further aspect of the invention, the set of supplementary tuners are inset within an inset channel of the right lower bout with the stem of each tuner extending through the instrument soundboard.

In an additional aspect of the invention, the set of supplementary tuners are attached to an extension base attached to the left upper bout, extend outside the outer peripheral contour of the upper bout, and do not project through the instrument soundboard.

In a further aspect of the invention, the set of supplementary tuners are attached to an extension base attached to the right lower bout, extend outside the outer peripheral contour of the lower bout, and do not project through the instrument soundboard.

In another aspect of the invention, the set of supplementary tuners are attached to an extension base that is inset within an inset channel of the left upper bout with the stem of each tuner projecting through the instrument soundboard.

In a further aspect of the invention, the set of supplementary tuners are attached to an extension base that is inset within an inset channel of the right lower bout with the stem of each tuner projecting through the instrument soundboard.

In another aspect of the invention, the set of supplementary tuners are attached within an opening in the rib and supported by a top brace and a bottom brace.

In an additional aspect of the invention, the terminal ends of the sympathetic strings are attached to a single supplementary tailpiece.

In another aspect of the invention, the terminal ends of the sympathetic strings are attached to multiple supplementary tailpieces.

In an additional aspect of the invention, the terminal ends of the sympathetic strings are supported by a string termination assembly, a part of which is disposed inside the rib of the instrument, and are terminated on the outside of the rib.

In another aspect of the invention, the terminal ends of the sympathetic strings are supported by a string termination assembly, a part of which is disposed inside the rib of the instrument, and are terminated on the inside of the rib.

In a further aspect of the invention, multiple supplementary bridges support the sympathetic strings.

In another aspect of the invention, a single supplementary bridge supports the sympathetic strings.

In an additional aspect of the invention, the one or more supplementary tailpieces have one or more adjustable fine tuners.

In a further aspect of the invention, the one or more tailpieces lack fine tuners.

In another aspect of the invention, there are twelve sympathetic strings.

In an additional aspect of the invention, there are more than twelve sympathetic strings.

In a further aspect of the invention, there are less than twelve sympathetic strings.

In another aspect of the invention, a pickup is included that captures or senses vibrations produced by the strings and that converts these vibrations to an electrical signal.

In an additional aspect of the invention, one or two conventional corners between the C-bout and the upper and/or lower bouts may be eliminated and replaced with a rounded corner.

In a further aspect of the invention, the soundboard or face of the instrument is mirrored.

In another aspect of the invention, the soundboard or face of the instrument comprises a display screen.

In a further aspect of the invention, a lighting feature is disposed within the interior of the instrument.

In another aspect of the invention, a power source is at least partially disposed within the interior of the instrument.

In an additional aspect of the invention, a connection for a fog machine is integrated into the back or sides of the instrument.

In a further aspect of the invention, an access door is provided within the rib portion of the instrument to provide access to the interior for maintenance.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

FIG. to is a right end perspective view of the third embodiment of the present invention.

Figure 11:
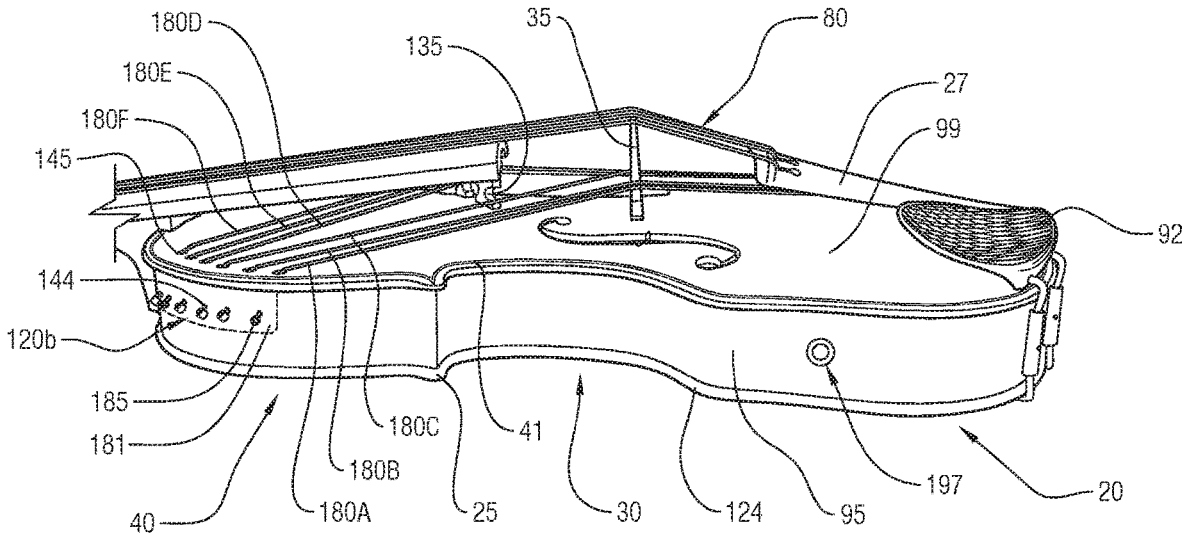

FIG. 11 is a side view of the third embodiment of the present invention.

Figure 12:
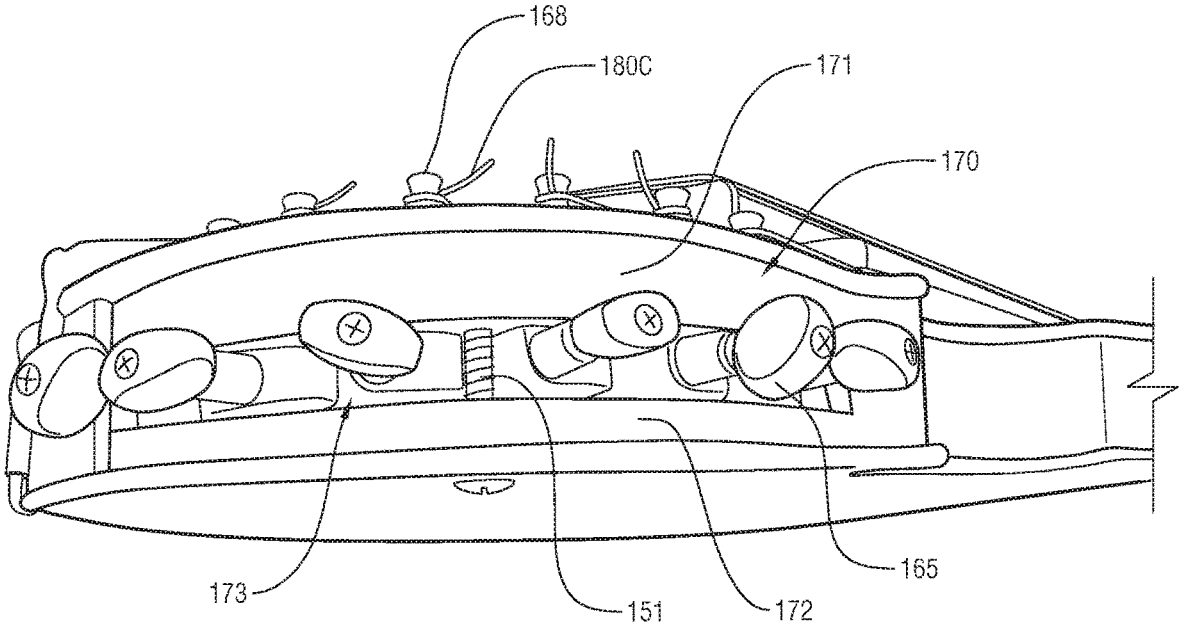

FIG. 12 is a perspective side view of the right lower bout with installed tuners of the third embodiment of the present invention.

Figure 13:
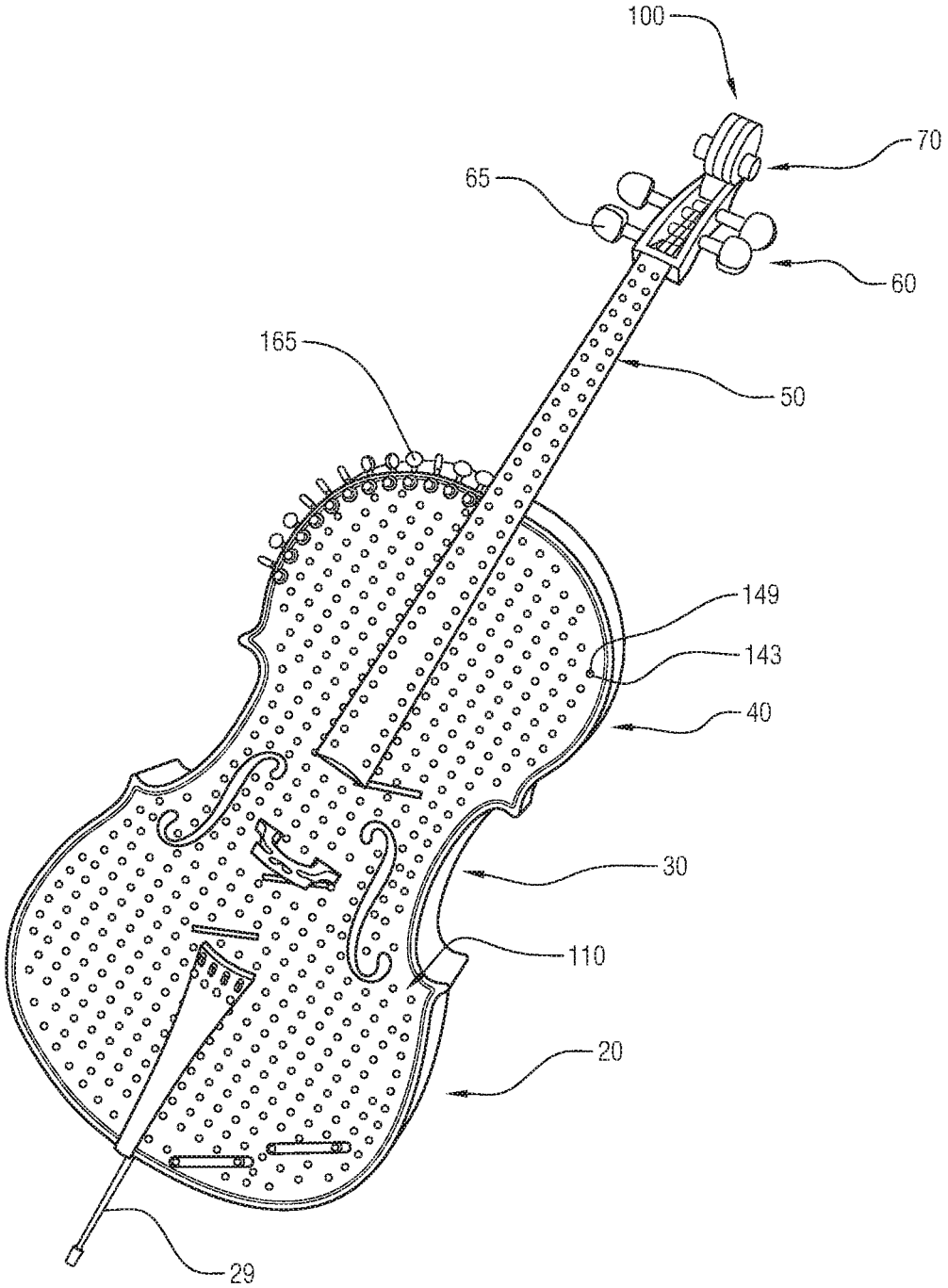

FIG. 13 is a front perspective view of the instrument body illustrating a lighted aspect of the present invention with the sympathetic strings removed.

Figure 14:
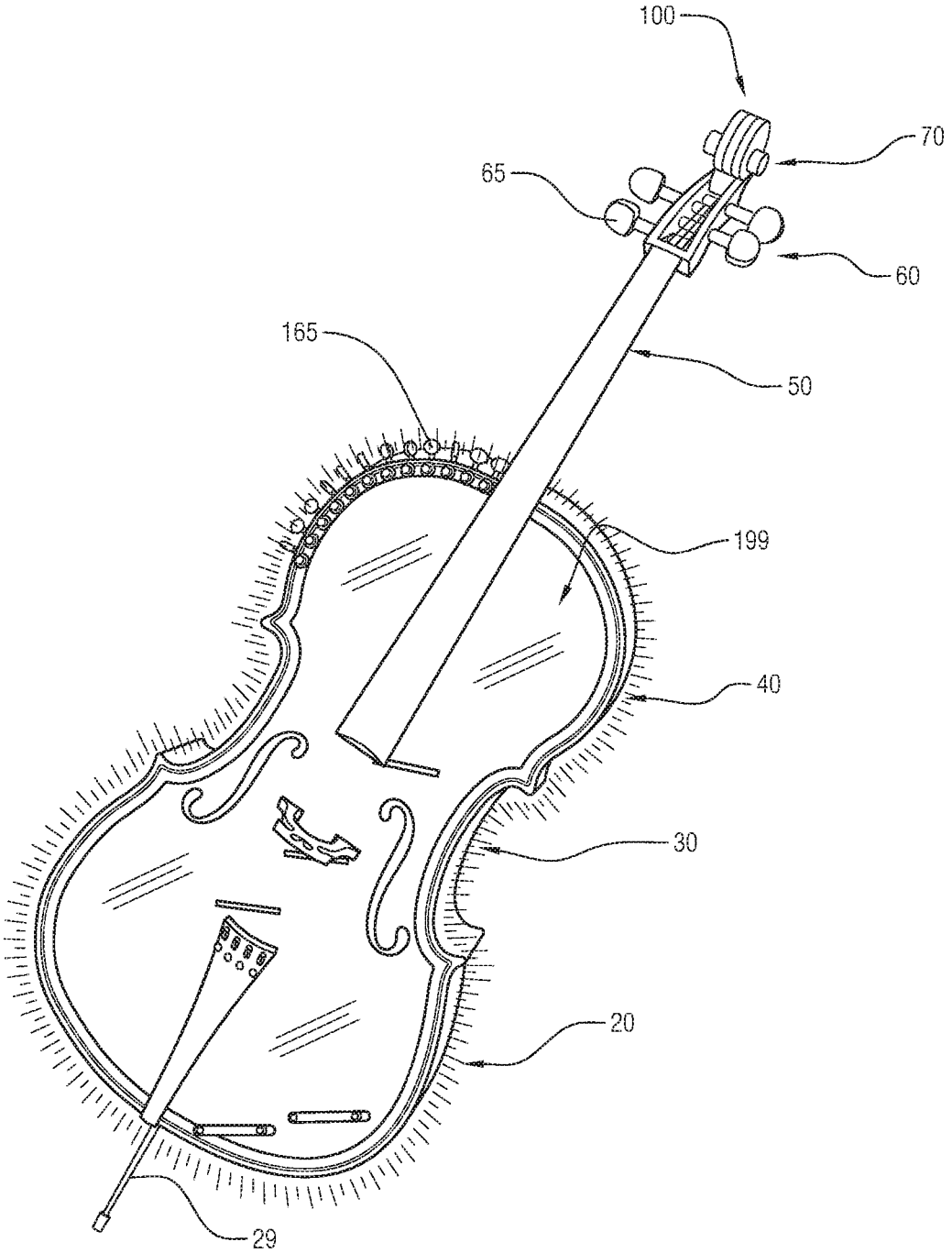

FIG. 14 is a front perspective view of the instrument body illustrating a mirrored or display screen aspect of the present invention with the sympathetic strings removed.

Figure 15:
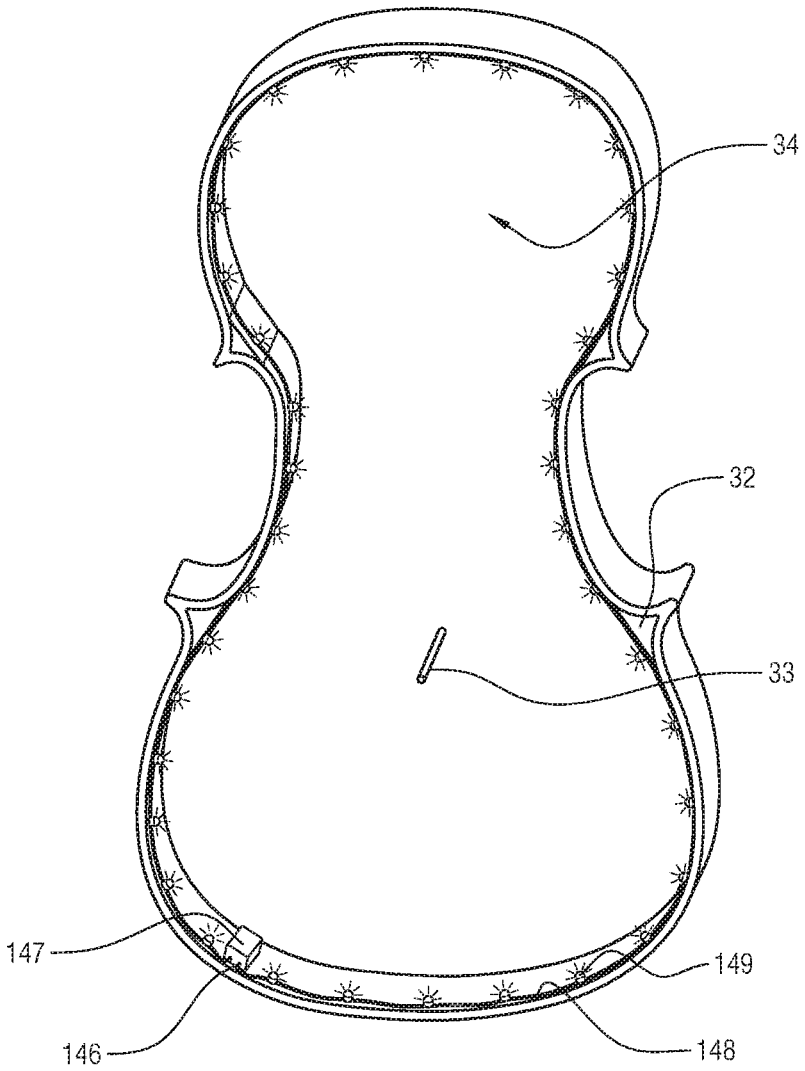

FIG. 15 is an interior front perspective view of the instrument body illustrating a first lighted aspect of the present invention.

Figure 16:
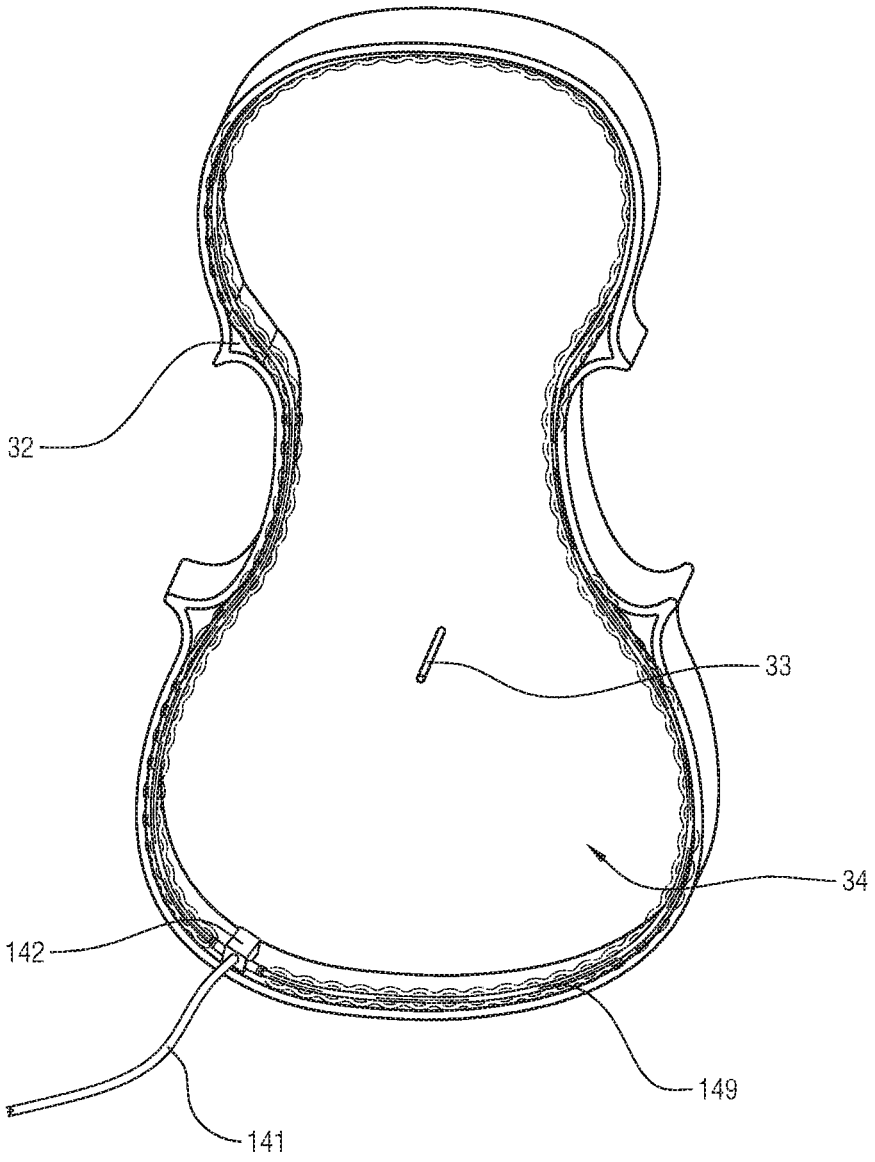

FIG. 16 is an interior front perspective view of the instrument body illustrating a second lighted aspect of the present invention.

Figure 17:
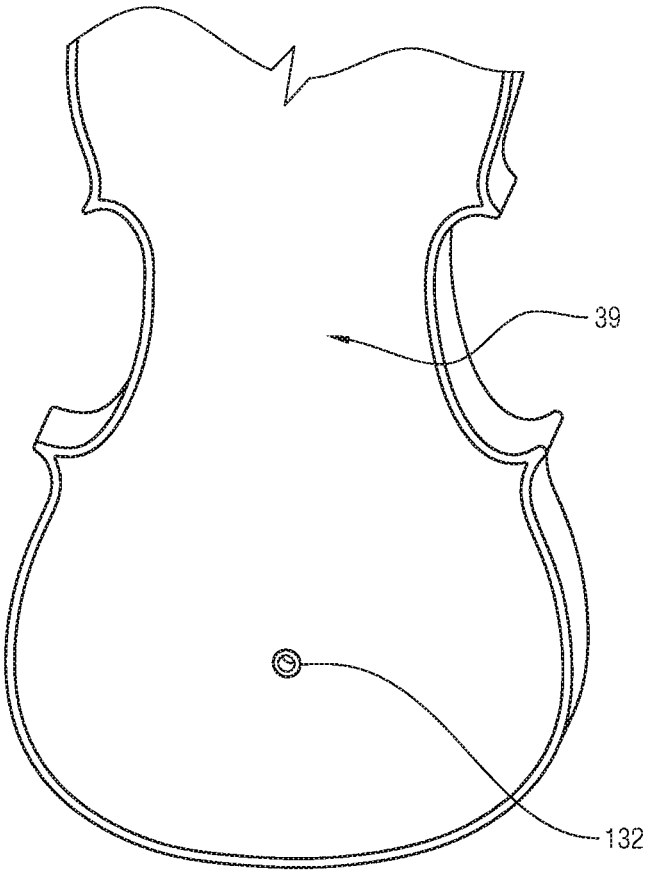

FIG. 17 is a partial back perspective view of a lower portion of the instrument body of the present invention.

Figure 18:
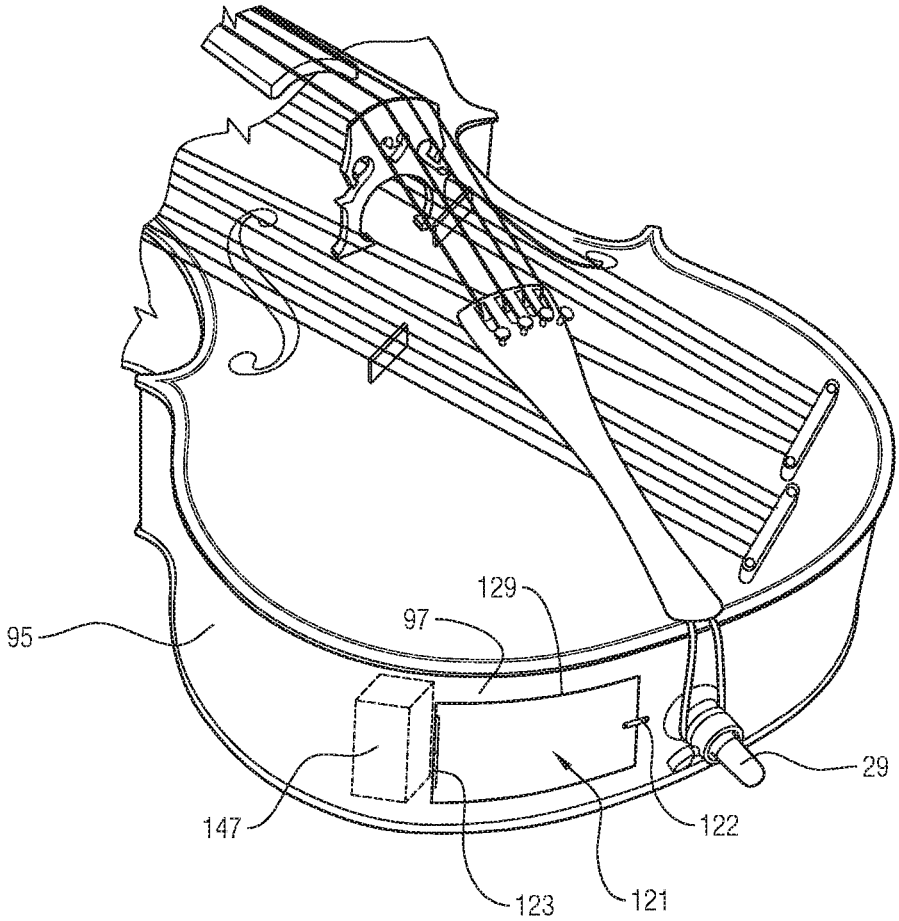

FIG. 18 is a partial perspective view looking from the lower left of the instrument of the present invention.

Figure 19:
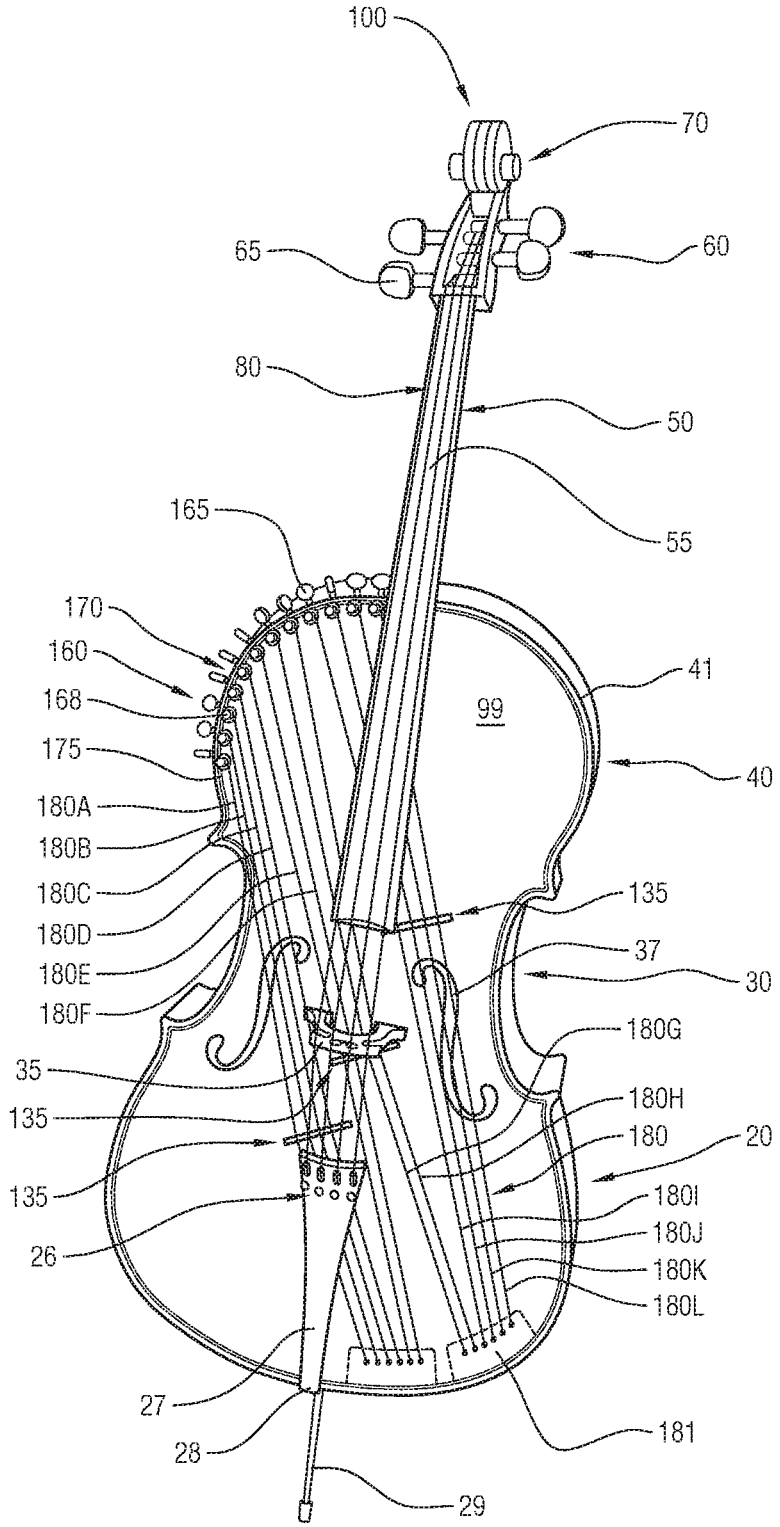

FIG. 19 is a front perspective view of a fourth embodiment of the present invention.

Like reference numerals refer to like parts throughout the several views of the drawings.

DETAILED DESCRIPTION OF THE INVENTION

Shown throughout the figures, the present invention is directed toward a bowed stringed instrument with sympathetic strings, which is shown generally as reference number 100. As illustrated in accordance with the embodiments of the present invention, the bowed stringed instrument 100 is enhanced with sympathetic strings 180. The stringed instrument 100 enhanced with sympathetic strings 180 may be based on any of a variety of bowed stringed instruments, such as the violin, viola, cello, bass, or the like. The addition of the sympathetic strings 180, which are disposed diagonally across the face (soundboard) of the instrument, increases both the projection and the resonance of the musical sound, along with increasing the capacity for musical variation by enabling strumming or plucking of the sympathetic strings 180.

Figure 5:
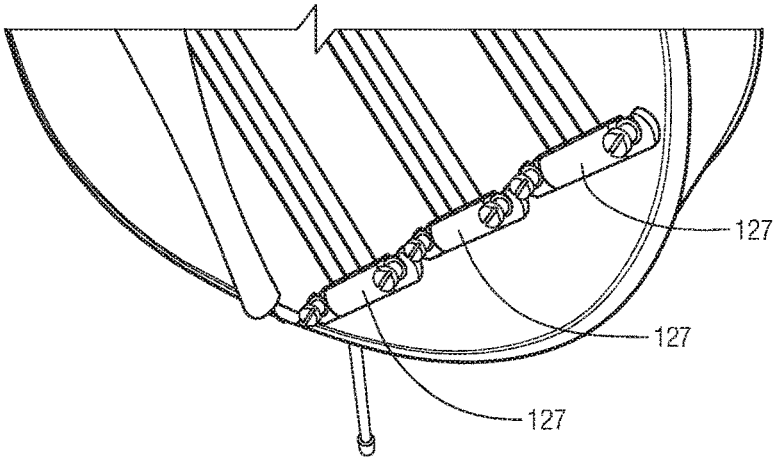
FIG. 5 is a partial front perspective view of a lower portion of the lower bout of the bowed stringed instrument with sympathetic strings of the present invention, which shows a second tailpiece aspect.
Figure 6:
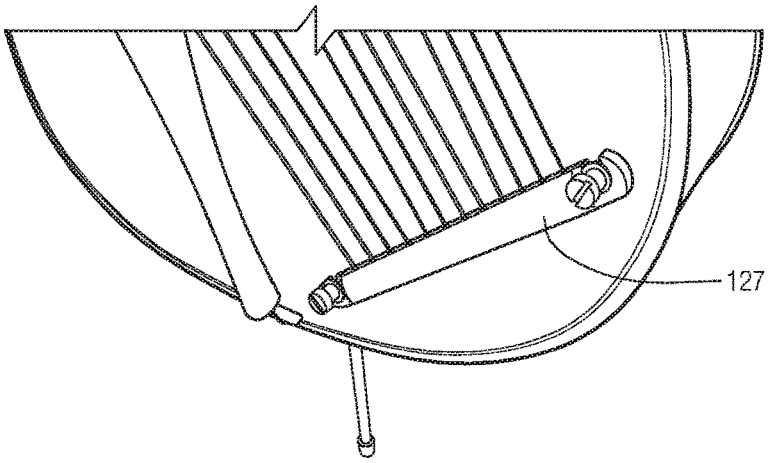
FIG. 6 is a partial front perspective view of a lower portion of the lower bout of the instrument with sympathetic strings of the present invention, which shows a third tailpiece aspect.
Figure 7:
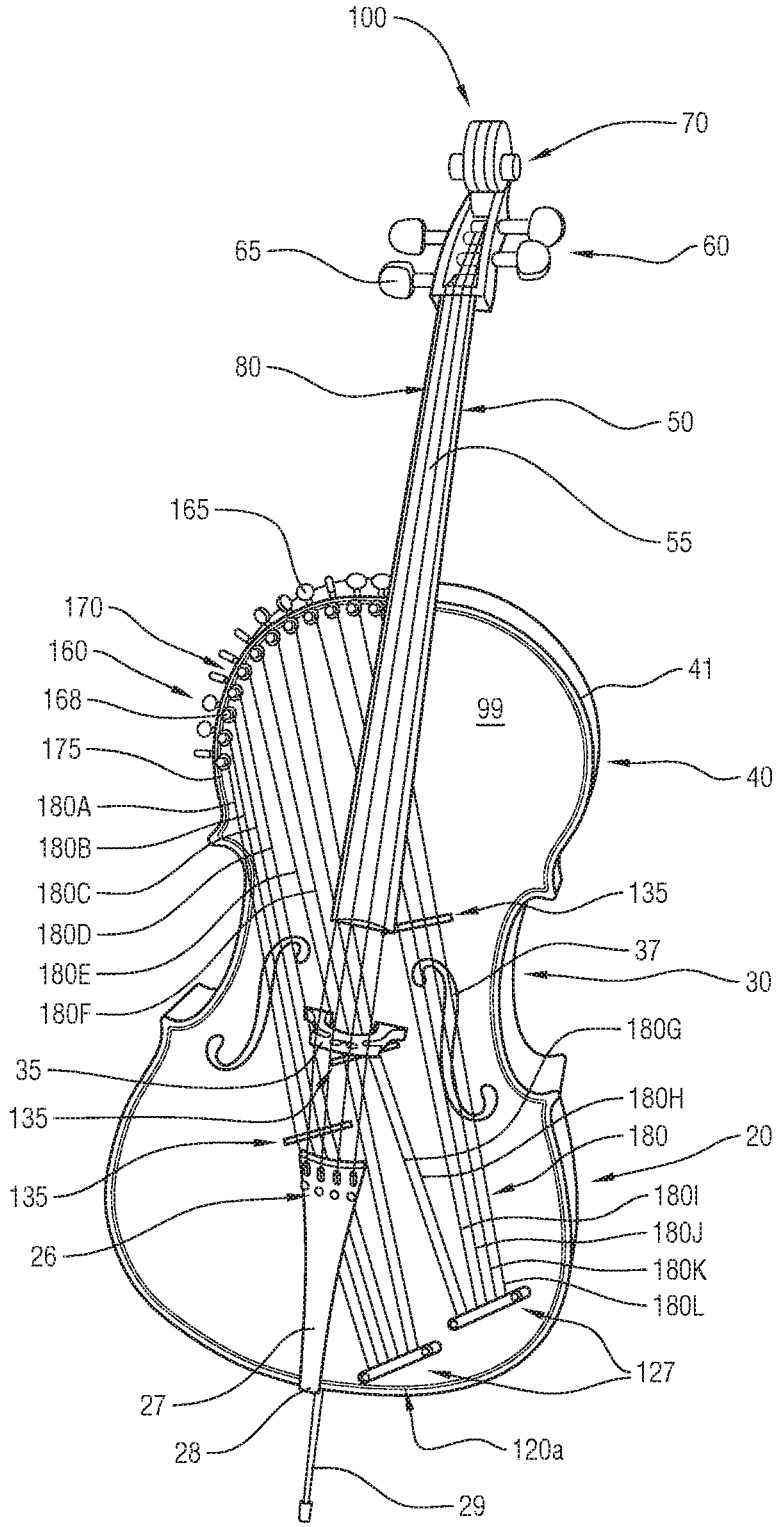
FIG. 7 is a front perspective view of a second embodiment of the bowed stringed instrument with sympathetic strings of the present invention which shows inset tuners.
Figure 8:
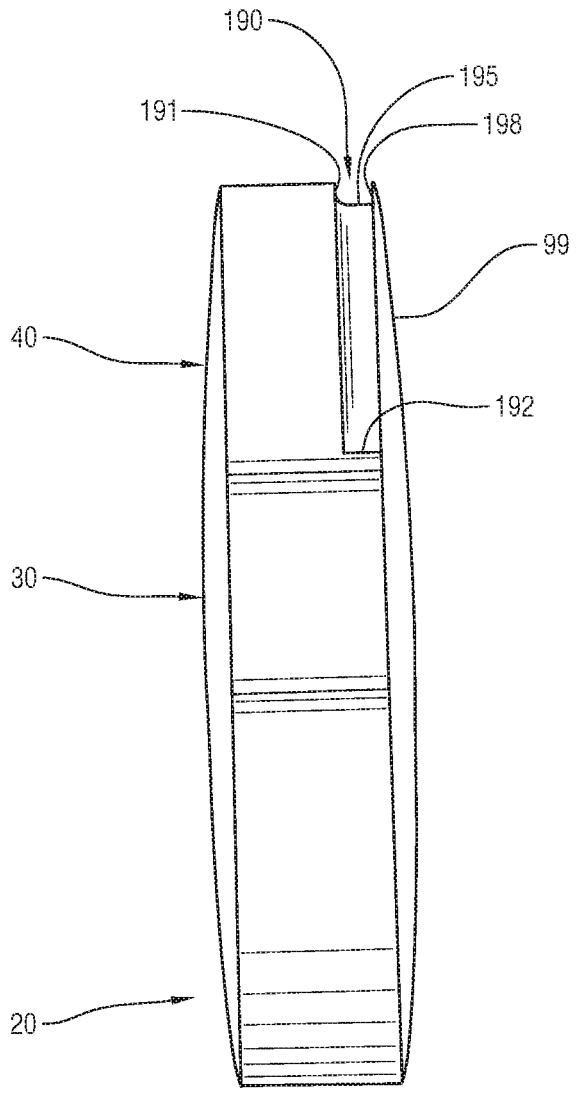
FIG. 8 is a side view of the body of the second embodiment of the bowed stringed instrument with sympathetic strings of the present invention showing the inset channel or trough of the left upper bout that functions to receive the inset tuners.

The first embodiment of FIGS. 1-6, the second embodiment of FIGS. 7-8, and the fourth embodiment of FIG. 19 show a cello variation (which shares most features with the bass variation), and the third embodiment of FIGS. 9-12 shows a violin variation (which shares most features with the viola variation). In all the embodiments, the bowed stringed instrument comprises primary elements corresponding to standard instrument elements in addition to sympathetic strings 180 along with supplementary elements that connect, support, position, and allow the tuning of the sympathetic strings 180. The primary elements of the sympathetic string-enhanced instrument 100 that correspond to the elements of the standard stringed instrument are essentially the same size and shape and are joined together in essentially the same manner as the standard stringed instrument elements. For clarity of discussion, the primary elements of the sympathetic string-enhanced instrument 100 are generally numbered in the two-digit numbers while the inventive elements are generally numbered in the three-digit numbers. The sympathetic string-enhanced instrument 100 of the present invention is preferably produced as a full-size instrument, as is described herein, but may optionally be produced in a reduced size, such as for younger players. However, all exemplary dimensions given are in reference to the full-size instrument.

The sympathetic strings 180 may be activated in at least three ways. The player may pluck the strings 180, strum the strings 180, or trigger the sympathetic sound of the strings 180 vibrations by bowing one or more of the primary strings 80. When the player bows the primary strings 800 of the novel instrument 100, bowed vibrations are created that are passed through the primary bridge 35 down to the soundboard 99 of the instrument, and that then resonate in the resonance cavity of the body of the instrument. The bowed vibrations also travel up the supplementary bridges 135 and activate the sympathetic string 180 that corresponds to the pitch being played by the primary bowed string 80. The vibration is not dampened after the player moves on to another note, therefore the sympathetic string 180 continues to resonate until its natural decay. This creates the reverb effect. However, when and if desired, the sympathetic strings 180 may be optionally muted by the player's hand or by a separate damper device (such as one that can be controlled by the hand or the knees).

Four embodiments of the novel bowed stringed instrument 100 are described along with additional variations and aspects of the invention. The first, second, and fourth embodiments illustrate the invention as applied to bowed stringed instruments such as cellos, basses, and other instruments that are rested on the floor when being played. The third embodiment of FIGS. 9-12 illustrates the invention as applied to bowed stringed instruments such as violins, violas, and other handheld instruments. Though the embodiments and aspects show the invention applied to specific instruments, the elements and designs shown may be applied to other bowed stringed instruments.

Figure 1:
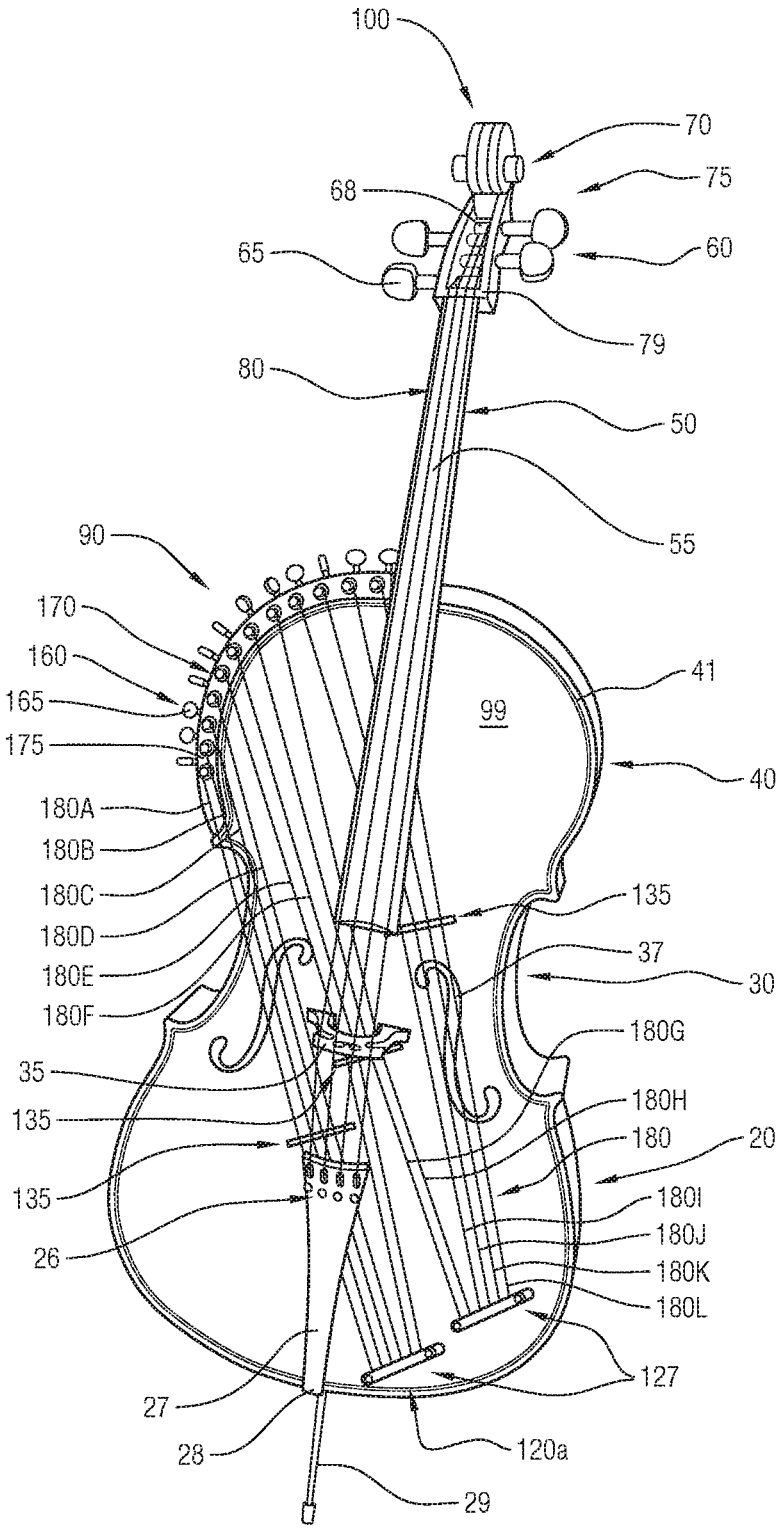
FIG. 1 is a front perspective view of a first embodiment of the present invention, the cello variation of the bowed stringed instrument with sympathetic strings, which has extended tuners that attach to an extension base and that reach beyond the peripheral contour of the left (player's right) upper bout.
Figure 2:
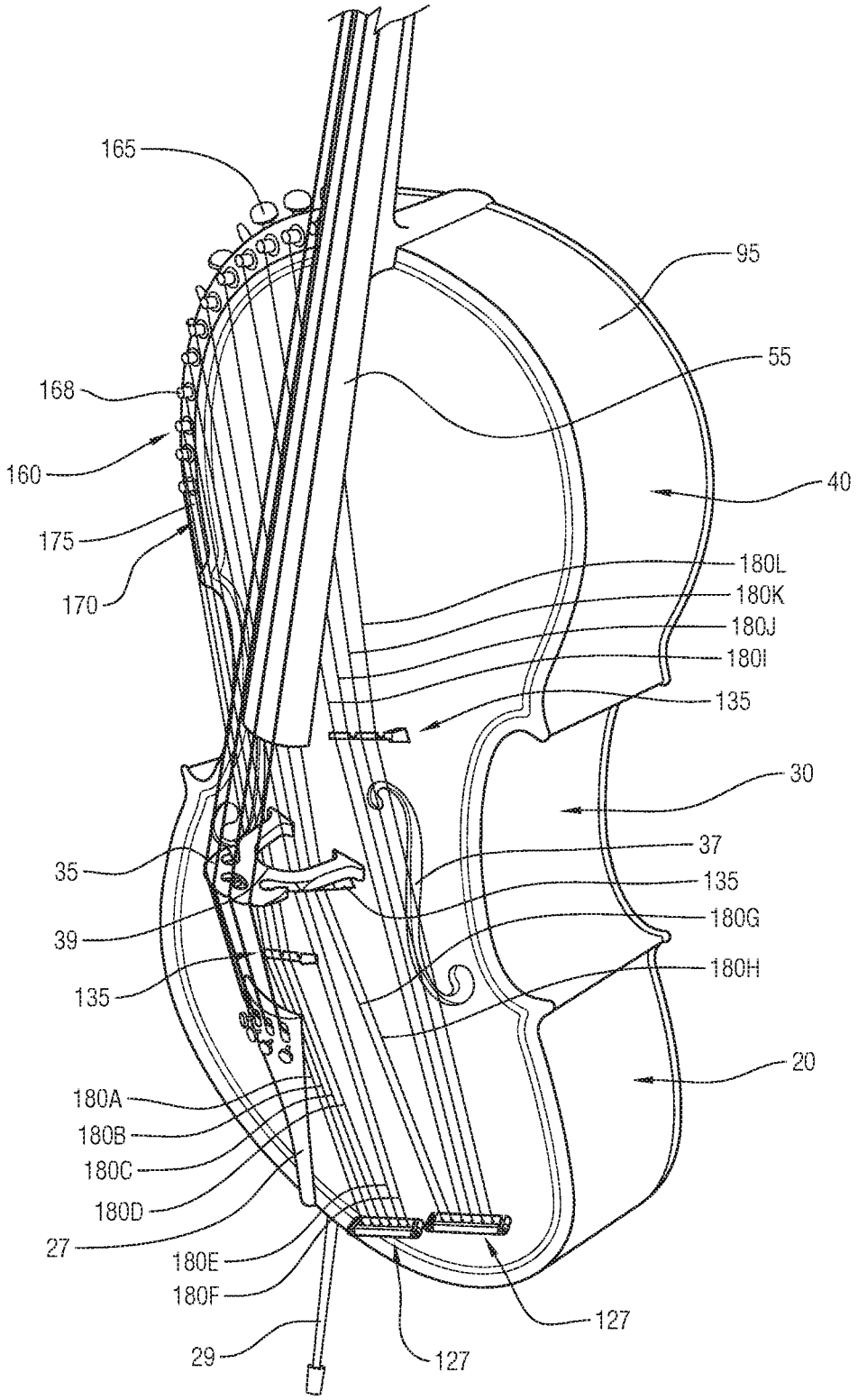
FIG. 2 is a right (player's left) front side perspective view of the first embodiment of the bowed stringed instrument with sympathetic strings of the present invention.
Figure 3:
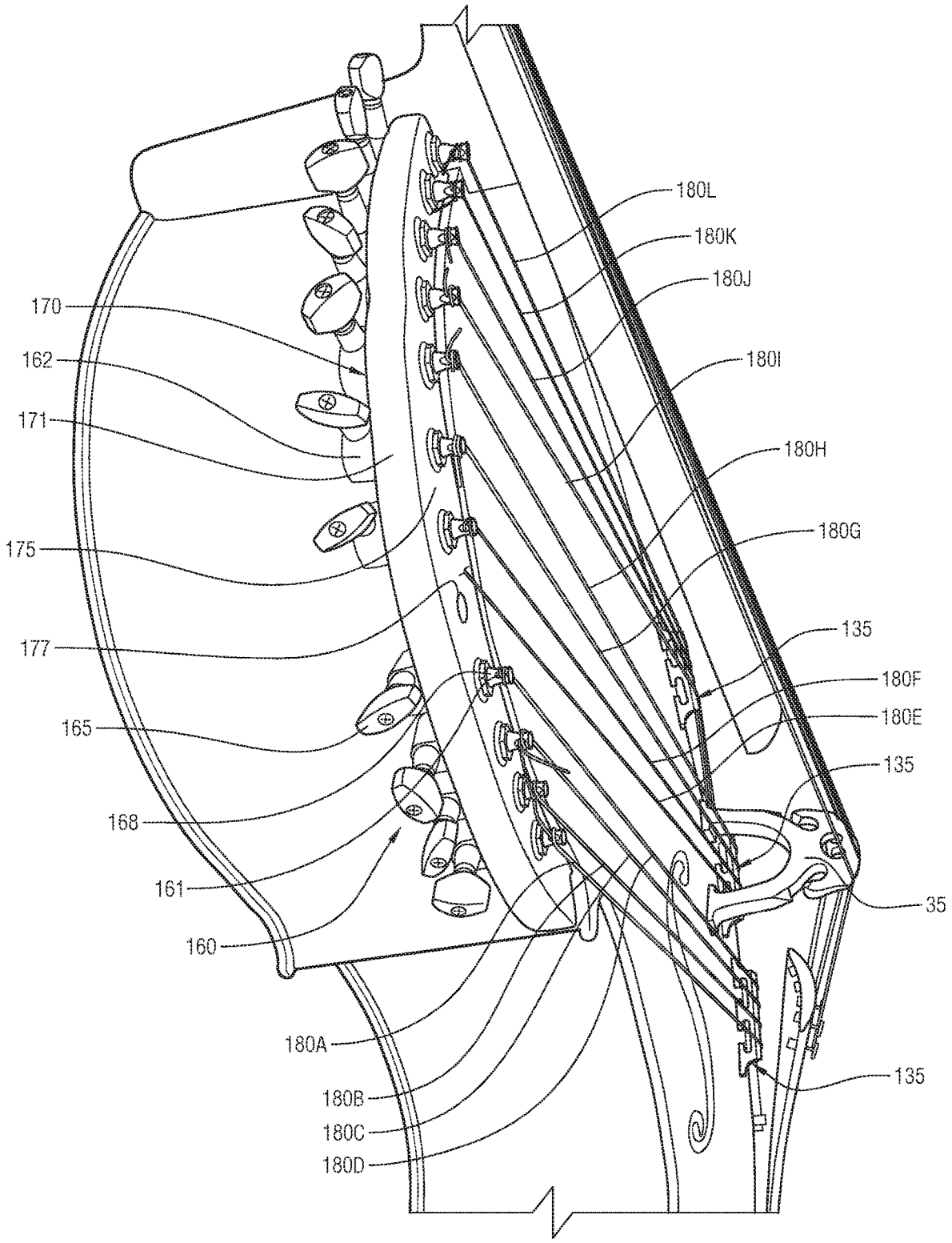
FIG. 3 is a partial left top side perspective view of the first embodiment of the bowed stringed instrument with sympathetic strings of the present invention with one string removed to allow viewing of an extension base hole.
Figure 4:
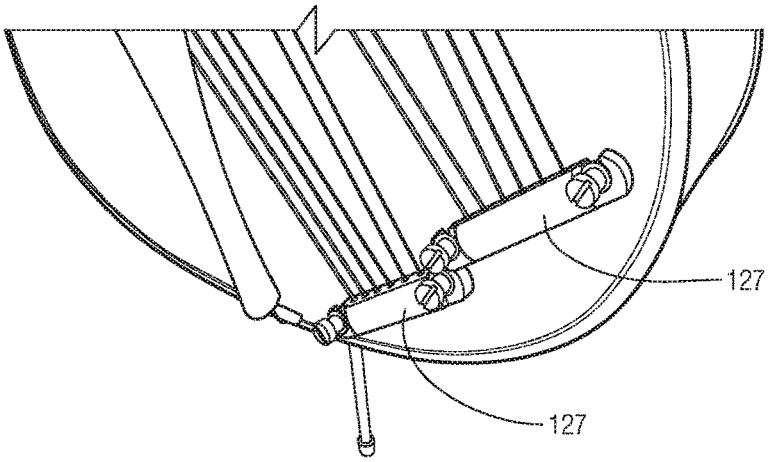
FIG. 4 is a partial front perspective view of a lower portion of the lower bout of the bowed stringed instrument with sympathetic strings of the present invention, which shows a first tailpiece aspect.

The first embodiment, shown in FIGS. 1-3, has supplementary strings 180 extending between extended supplementary tuners 160 and a tailpiece(s)-type termination structure 120*a*. The second embodiment, shown in FIGS. 7-8, has supplementary strings 180 extending between inset supplementary tuners 160 and tailpiece(s)-type termination structure 120*a*. The third embodiment, shown in FIGS. 9-12, and the fourth embodiment, shown in FIG. 19, both have supplementary strings 180 extending between inset supplementary tuners 160 and a concealed termination structure 120*b*. FIGS. 4-6 illustrate additional aspects of the supplementary tailpiece(s)-type termination structure 120*a* of the invention. FIGS. 13-18 illustrate aspects that visually amplify the stringed instrument, particularly lighted elements.

The first embodiment will be described as applied to the cello with the understanding that this is an exemplary application to a specific instrument and that the elements and principles can be used with other bowed stringed instruments. The primary cello elements comprise the following: a body 900 comprising a wide lower bout 20; a narrow intermediary waist or C-bout 300; a wide upper bout 40; four corners 25 (two disposed between the C-bout 30 and the lower bouts 20 and two disposed between the C-bout 30 and the upper bouts 40); sides or rib 95 (usually a single continuous rib running completely around the body); a face or soundboard 99 having an outer peripheral contour that is typically embellished with purfling 41 (for decoration and/or to minimize cracking of the soundboard); a neck 50 (attached to the fingerboard 55); a pegbox 75 that houses four primary tuners 60 (typically tapered friction tuners, although gear tuners may be used); a scroll 700; a nut 79 with string grooves or slots; four primary strings 80 that extend from the primary tuners 60 through grooves in the nut 79 over a primary bridge 35 and on to a primary tailpiece 27; f-holes 37 (defined by f-hole edges cut within the soundboard 99 and disposed substantially within the C-bout 30); a tailgut 28; an endpin system 29 (including endpin and endpin supports); optional primary tailpiece fine tuners 26; optional cornices (sharply cornered projections at the junctures of the bouts, which are shown in the figures, but are not necessary to the invention); and interior components, including the soundpost 33 (FIGS. 15-16), bass bar (not shown), corner block 32, and interior resonant cavity 34. The upper end of each of the four primary strings 80 is wrapped around the post or stem 68 of a primary tuner 60, which is functional to tighten or loosen the primary string 80 to tune the cello. Each tuner 60 includes a head (also termed a "knob" or "thumb twist") 65 to adjust the string tension and a stem 68 configured to receive the upper end of the string 80 being installed. The curved primary bridge 35, disposed on the front of the soundboard 99, supports the primary strings 80 a proper distance from the soundboard 99 and enables the musician to bow individual strings 80.

In addition to these primary elements corresponding to the standard cello elements, the enhanced instrument too includes the sympathetic strings 180 and associated supplementary elements. The associated supplementary elements comprise one or multiple supplementary bridges 135, one or multiple supplementary string termination assemblies 120 (such as a supplementary tailpiece 127 of termination assembly 120*a* as shown in FIGS. 4-7 or a concealed termination structure 120*b* as shown in FIG. 11 with an interior reinforcement 181 through which the strings 180 run to exit at small holes 144 to end at a string extremity terminator 185), and supplementary tuners 160.

The multiple sympathetic strings 180 are disposed diagonally across the front of the cello soundboard 99 and are disposed close to the soundboard 99, but they are spaced away from the soundboard 99 a distance great enough to eliminate (or at least greatly mitigate) hitting the front of the soundboard 99. In an aspect of the invention, there are twelve sympathetic strings 180, although, optionally, the novel instrument 100 may be fashioned with other numbers of sympathetic strings 180, as desired, to produce other musical and/or tonal relationships.

The upper end of each sympathetic string 180 engages with the stem 168 (FIG. 2) of a supplementary tuner 160, a middle portion of each sympathetic string 180 is supported by a supplementary bridge 135 (or in some aspects supported by a leg portion of the primary bridge 35), and the lower end engages with a supplementary string termination assembly 120. The sympathetic strings 180 lie underneath the fingerboard 55, under the inner edge 39 (FIG. 2) of the primary bridge 35, and primary tailpiece 27. In one aspect of the invention, the primary bridge 35 may be slightly elevated to provide more room for the sympathetic strings 180.

In the aspect illustrated in FIGS. 1-3, an extension base 170 is connected to the top left bout of the cello 100. The extension base 170 provides a foundation to which the tuners 160 may be attached in a convenient manner with minimal effect on the hollow body 90 and on other elements. The tuner stems 168 protrude through extension base holes defined by hole edges 177 (FIG. 3) and project through the face 175 of the extension base 170 with the tuning heads 165 disposed behind extension base 1700.

The extension base 170 may be connected to the top left bout of the cello 100 in any of a variety of ways, such as adhesively attached, attached by mounting screws, attached by a combination of adhesive and mounting screws, or formed integrally with the body of the cello 100. The extension base 170 has a shape that mimics the contour of the upper bout 40. The extension base 170 may take any of several forms that fulfill the function of attaching the tuners 160 to the body 90. For example, the extension base 170 may be connected to the outer edge of the upper left rib 95, may be connected at the intersection of the junction of the top left bout and the rib 95 without modifying the top left bout and rib 95, or may be connected by removing a small section from one or both of the top left bout and rib 95 to allow the base 170 to be seated more securely. In one aspect, the base 170 may be a curved wood molding that follows the curve of the upper bout and is thick enough, and attached securely enough, to resist the tension of the strings 180. In another aspect, the base 170 may be shaped with an upward portion supported by a lower angled underside portion. In this aspect, the base 170 may have a right angle or L shape, with a first, front leg of the L shape fitting extending vertically from substantially the top edge of the soundboard 99 and with the second leg of the L shape fitting horizontally on the outer edge of the upper left rib 95. The extension base 170 may have approximately the depth of a guitar peghead, which will allow standard guitar tuners to be used, or may be somewhat deeper than a standard guitar peghead.

The supplementary tuners 160 may be conventional tuners or may be customized for this application. The series of supplementary tuners 160 are substantially evenly spaced from approximately the neck area spreading along the peripheral edge of the left upper bout 40 from the neck area toward the C-bout 30. Preferably, the tuners 160 are of the geared type, which includes the vintage type (such as open back type), the sealed machine head gear type (as illustrated), or other geared types as is known or becomes known in the art. Optionally, the tuners 160 may be of the friction type with a tapered stem. Each tuner may comprise a head 165 that is grasped and turned to tighten or loosen the string 180, a gear box 162 that may be open-backed or closed (such as a diecast metal housing enclosing a worm gear and cog), a stem 168 configured with a stem hole 161 to receive the string end, a mounting mechanism, and, with some styles of tuners 160, a bushing. The mounting mechanism may be, for example, a tab with a hole to receive a screw or may be an indexing pin disposed under the gear housing 162 that is engaged with the base 1700. Though shown as a geared type guitar tuner 160, the tuners 160 may be of any of a variety of types of tuners, as is known, or becomes known, in the art.

Twelve supplementary sympathetic strings 180 are illustrated, which are designated 180A to 180L, though other numbers of strings 180 are within the scope of the invention. String 180A is attached lower on the left upper bout near the C-bout and extends diagonally; it passes over the supplementary bridge 135 and ends at the right of the primary tailpiece 27, with its lower end confined in the left-most position of the leftmost supplementary tailpiece 127. The sympathetic strings 180 continue in a spaced manner, as shown in the figures. The middle four strings 180E, 180F, 180G, 180H run from the middle four tuners 160, between the feet of the primary bridge 35, over the middle supplementary bridge 135, and end at the middle supplementary tailpiece 127. The last string 180L is attached on the left bout near the upper center of the cello, extending diagonally, passing over the right supplementary bridge 135, and ending at the right lower bout in the right-most position of the right supplementary tailpiece 127. The spacing of the tuners 160, the grooves of the bridges 135, and the receiving holes of the tailpiece(s) all contribute to maintaining the strings 180 at a proper spacing. These spacings may be varied based on factors such as tonal considerations as well as the number and placement of tuners 160, bridges 135, and supplementary string termination assemblies 120. In an example, the space between the strings at the tuners 160 may be between approximately 1 inch and 0.375 inch, the space between the strings 180 at the supplementary bridge may be approximately 0.25 inch, and the spacing at the tailpiece may be approximately 0.5 to 0.75 inch.

The supplementary sympathetic strings 180 may be tuned in a variety of ways. They can be tuned, for example, for specific key signatures, if desired. Because the supplementary bridges 135 are positioned near the middle of the sympathetic strings 180, the strings 180 can vibrate pitches both above and below the bridges 135. Therefore, each string makes two separate pitches. When considering tuning, the pitches referenced will be the ones above the bridge 135. Although steel guitar strings can be used for the sympathetic strings 180, preferably customized strings are used. Optionally, the strings 180 can be installed in different orders to create different orders of notes. In an example, the sympathetic strings 180 number twelve, as illustrated, and may be tuned from string 180A to 180L as follows: A, D, F sharp, B, G sharp, C sharp, C, E, G, D, A, and E. The pitches that are not present in this string tuning, such as B flat, E flat, and F are present on the bottom half of the strings 180 below the bridges 135. Moving the bridges 135 will also change the string length, and, therefore, change the pitch.

The termination structure 120 (in this embodiment, the tailpiece or tailpieces 127) functions to anchor the lower ends of the strings 180 to the cello body. The tailpiece(s) is not disposed horizontally but is angled diagonally with respect to the cello body to accommodate the diagonally-extending strings 180 that will be engaged within its grooves. The tailpiece(s) is generally oriented to form a right angle with the sympathetic string 180. The tailpiece may have holes to receive the end of the string 180 and a mechanism to secure the end of the string 180. Optionally, the supplementary tailpiece 127 may comprise one fine tuner or multiple fine tuners, up to as many fine tuners as the number of strings.

FIGS. 4-6 show variations in the number of tailpieces 127 for the inventive enhanced instrument 100. In the aspect shown in FIGS. 1-2, 4, and 7, two tailpieces 127 are shown, which are both attached to the lower portion of the right lower bout 20 to the right of the primary tailpiece 27. When two tailpieces 127 are used, the left tailpiece 127 may need to be slightly lower than the tailpiece 127 to its right due to the width of the tailpiece 127 and the mounting hardware. In the aspect shown in FIG. 5, three smaller tailpieces 127 are shown that are all attached to the lower portion of the right lower bout 20. Each of the three tailpieces 127 may need to be offset from the adjacent tailpiece 127 to accommodate mounting hardware. Three smaller tailpieces 127 may have an advantage in that they can be individually positioned to an optimum angle and level, which may allow the strings to advantageously run straighter. In a further aspect, which is shown in FIG. 6, a single tailpiece 127 is attached to the lower portion of the right lower bout 20 and is designed to accommodate all twelve of the sympathetic strings 180. Compared to the multiple tailpieces 127, the single tailpiece 127 has the advantage that less mounting hardware is required. The tailpiece(s) 127 can be made of any of several types of wood or of composite material and may be black or other colors.

The two exemplary tailpieces 127 illustrated are electric guitar tailpieces that hold six strings 180 each. Since ideally, the strings 180 would run in a straight line or nearly in a straight line, customized tailpieces that promote straight strings are preferred.

Each sympathetic string 180 is supported at an intermediary location between the stem 168 and the supplementary tailpiece 127 by one of the one or more supplementary bridges 135. The one or more supplementary bridges 135 are disposed generally perpendicularly to the string 180. Similar to the function of the primary bridge 35, the supplementary bridge 135 not only supports the strings 180 to allow the strings to vibrate freely, but also transfers that vibration to the resonant cavity 34 (FIG. 15) of the body. Though the strings 180 are laid close to the outermost surface of the soundboard 99, the supplementary bridge 135 elevates the string 180 sufficiently from it so that the sympathetic string 180 does not interact with it, yet the bridge 135 does not elevate the sympathetic string 180 to the degree that it would interact with the primary strings 80 that are borne by the primary bridge 35. The height of the bridge 135 may vary, depending on parameters such as the arch of the soundboard 99 and the height of the primary bridge 35. A flatter soundboard 99 can have a lower bridge, while a soundboard 99 with more arch will require a higher bridge. For example, the supplementary bridge 135 may have a height from the soundboard 99 to the bottom of the body of from 0.25 inch to 1.5 inches.

In the first embodiment, three supplementary bridges 135 are illustrated, but the number of supplementary bridges 135 may be from one up to the number of strings 180. In the figures, the right supplementary bridge bears the right four strings 180I, 180J, 180K, and 180L, the intermediary supplementary bridge 135 bears the middle four strings 180E, 180F, 180G, and 180H, and the left supplementary bridge bears the left four strings 180A, 180B, 180C, and 180D. The right supplementary bridge 135 is positioned on the soundboard 99 of the body at a horizontal location generally right of the finger board and positioned vertically in the upper portion of the C-bout 30, which may be around 12 to 13 inches from the tuners 160. The intermediary supplementary bridge 135 is positioned near the primary bridge 35, which is horizontally between the F-holes and vertically in the lower portion of the C-bout 30 at about 15.5 to 16.5 inches from the tuners 160. The left supplementary bridge 135 is positioned in the horizontal direction to the left of the center of the instrument 100 and vertically below the C-bout 30 and in the upper half of the lower bout 20 at about 13.5 to 14.5 inches from the tuners 160. Due to the diagonal orientation of the sympathetic strings 180, the supplementary bridge 135 is not parallel to the horizontal primary bridge 35 but is generally perpendicular to the string 180 it supports. In an example, the bridges 135 may be banjo bridges holding four strings each as shown, but in the interest of maintaining the string in as close to a straight line as possible, custom bridges are preferred over the banjo bridges illustrated.

Like the primary bridge 35, a supplementary bridge 135 may be a small piece of wood that holds the strings 180 away from the soundboard 99 and transfers vibration to the body. The supplementary bridge 135 has a bridge body and feet that support the body. The top of the bridge body is generally flat and configured with grooves, each of which accommodates a string 180. The feet do not have flat bottoms but are fitted to the contour of the soundboard 99. The feet support the supplementary bridge 135 on the soundboard 99. Like the primary bridge 35, the supplementary bridge 135 is typically not permanently attached to the soundboard 99 but is held firmly to the soundboard 99 under the tension of the strings 180. However, in one aspect of the invention, the supplementary bridge 135 may be integrally formed with the soundboard, such as, for example, if the soundboard is molded of carbon fibers or other synthetic material. The top grooves or slots function to space the strings so that they are held evenly as they run from the upper tuners 160 to the lower tailpieces 127. The strings 180 are preferably supported at a top groove of the bridge 135 at about the middle of the string 180.

In some aspects of the invention, a luthier designing the inventive enhanced stringed instrument 100 may design a bridge 35 that is particularly suited to accommodate the underlying sympathetic strings 180. In another aspect of the invention, one of the conventionally available bridge types may be used.

FIGS. 7-8 illustrate the second embodiment of the invention in which the tuners 160 are inset, as opposed to the extended tuners 160 of the first embodiment. In the second embodiment, at least a significant portion of the tuners 160 fit into a channel 190 (FIG. 8) that is incorporated into (and follows the contours of) the top front side or rib and is disposed directly behind the left upper bout 40 portion of the soundboard 99. The channel 190 extends from a lower end 192 above the junction of the C-bout 30 and the upper bout 40 (which, in some aspects, is above the interiorly disposed corner block) to near or at the top center of the instrument 100 and extends at least fifty percent of the distance along the edge contour of the left upper bout 40. The channel 190 is a generally U-shaped trough with the soundboard 99 (which is preferably reinforced) at the front 198 of the trough, the channel floor 195 forming the bottom of the trough, and the channel back wall 191 forming the back of the trough. The trough may be, for example, around an inch deep and an inch in depth, but the exact dimensions will depend on the dimensions of the specific tuners 160 to be received within the channel 190.

As described above, each tuner 160 comprises a knob or head 165 for turning, a gear box 162, and a stem 168 configured with a stem hole 161 to receive the string end, a mounting mechanism, and, with some styles of tuners 160, a bushing. As can be seen in FIG. 7, the stem 168 of each tuner 160 extends through the soundboard 99. The gear box 162 fits substantially within the channel 190 with the head 165 extending outwardly in a position to be manually grasped and turned.

In a variation on the second embodiment, instead of the channel 190 being inset into the rib 95 as in FIG. 8, the front edge of the soundboard 99 can be extended forwardly to create a forwardly extending channel 190 to receive the gear box of the tuners 160.

An advantage of the second embodiment is that the inset tuners protrude very little above the upper front corner of the left upper bout 40. This minimal protrusion will allow the second embodiment of the inventive enhanced instrument 100 to fit within some standard instrument carrying cases, thus advantageously expanding the case options for the user.

Though the first two embodiments have been illustrated as applied to a cello, the application to a bass is quite similar, though the sympathetic strings could be, and preferably would be, much longer due to the larger size of the soundboard 99 of the bass. The increase in length improves both projection of the musical sounds and resonance, which is quite advantageous to the bass, due to the current difficulty in clearly hearing the low tones of the bass in a concert hall setting. The addition of sympathetic strings 180 helps the low notes reach further, which is particularly beneficial in situations in which the bass is playing solo in front of an orchestra. When plucked, the very long sympathetic strings would ring longer than on other instruments with sympathetic strings; this could create very unique possibilities in terms of new solo bass compositions. The sympathetic strings would also have a slightly different tonal color when plucked than the primary strings when plucked, which would give nice options for jazz bass players and other bass players that primarily pluck the instrument.

The third embodiment of FIGS. 9-12 illustrates the addition of sympathetic strings to a bowed stringed instrument that is handheld when being played, as opposed to the instrument of FIGS. 1-8 that is rested on the floor while playing. In this embodiment the chin rest 92 (FIG. 11) is disposed on the right lower bout.

The sympathetic string-enhanced stringed instrument of the third embodiment includes many of the same elements, features, and functions as in the first two embodiments. As in the first two embodiments, the supplementary strings 180 run diagonally between the left upper bout and right lower bout. However, to accommodate the change of orientation during playing, the tuners 160 are disposed on the right lower bout and the supplementary string termination assembly 120*b* is disposed on the left upper bout; with this placement, the tuners 160 do not interfere with the bowing.

The supplementary strings 180 are supported by a supplementary bridge 135, multiple supplementary bridges 135, or a portion of the primary bridge 35 and a supplementary bridge 135. The primary bridge 35 may be modified, such as by advantageously forming the curves in the legs, to better support one or more of the supplementary strings 180.

The tuners 160 may be installed via the use of an extension base 170 that follows the contour of the right lower bout, extends outwardly beyond the contour of the right lower bout, and provides an attachment place, as in the first embodiment. Or the tuners 160 may be installed in a channel, as in the second embodiment. In the aspect of the invention shown in FIG. 10, the tuners 160 are installed in an open-bottom channel in the right lower bout rib area with a front bracing structure 171 and a rear bracing structure 172. Both bracing structures follow the curve of the lower bout and are sized to fit within the rib area while leaving an area between them (an opening, aperture 173) open. A support element 151 may be installed to provide structural support, which may be needed for robustness due to the elongated open-bottom channel. This added opening 173 slightly alters the sound that escapes from the instrument, so the musical sound is not identical to the sound from a standard instrument. In a concert hall setting, the open aperture 173 may provide additional benefits to listeners in the front few rows, who are often disadvantaged in that the sound from a conventional instrument reaches its full expression beyond the first few rows.

Although the supplementary string termination assembly 120*a* using one or more tailpieces 127 of the earlier embodiments can be used in the handheld instrument of the third embodiment, an alternative string termination assembly 120*b* is preferred. In this embodiment, the supplementary string termination assembly 120*b* includes small soundboard holes 145 (FIG. 9) on the upper left soundboard 99 of the instrument 100, an interior reinforcement 181 (such as a block of wood or plastic or other material to brace or strengthen the area) disposed adjacent to the interior wall of the upper left rib 95, small holes 144 (FIG. 11) in the upper left rib 95, and a string extremity terminator 185. In one aspect of the invention, to create the small holes 144, 145, a drill can be used to drill diagonally through the soundboard 99, through an interior block of wood forming the interior reinforcement 181, and through the rib 95. The small holes 145 in the soundboard 99 and the small holes 144 in the rib 95, as shown, allow the terminal end of the string 180 (wrapped around string extremity terminator 185, which may typically be a grooved cylindrical device known in the art as a "ball end") to be inserted into the rib holes 144, to proceed through the interior block of wood 181, and to exit the interior of the instrument through the exit holes 145 on the soundboard 99 near the purfling 41 (FIG. 1). Other types of string extremity terminators 185 may also be used. In another aspect, the strings 180 do not extend outwardly through the rib 95, but alternatively, the ends may be captured interior of the side rib 95, may be captured by the interior reinforcement 181, or may be captured and terminated by a string extremity terminator 185 disposed at or below the upper left soundboard 99 at the location shown by the face holes 145.

To install the supplementary strings 180, the interior reinforcement 181 is installed and the small holes 144, 145 are drilled as described. The ends of the strings 180 that are wrapped around a ball end type of string extremity terminator 185 remain on the outside of the rib 95, and the opposing ends of the strings 180 are inserted through the rib holes 144 in the rib 95, through the interior block, and come out the face holes 145. The strings 180 run over the primary bridge 35 or the supplementary bridge 135 to be attached to the tuners 160 where they end.

The preferred fourth embodiment of FIG. 19 is similar to the third embodiment of FIGS. 9-12 in that supplementary strings 180 run diagonally between the left upper bout and right lower bout and both have supplementary strings 180 extending between inset supplementary tuners 160 and a concealed termination structure 120*b*. However, the orientation of the inset supplementary tuners 160 and concealed termination structure 120*b* of FIG. 19 is inverted. The inset supplementary tuners 160 are inset within a channel, as in the second and third embodiments. The concealed termination structure 120*b* is disposed at the right lower bout, and it is formed as described in connection with the third embodiment.

Figure 9:
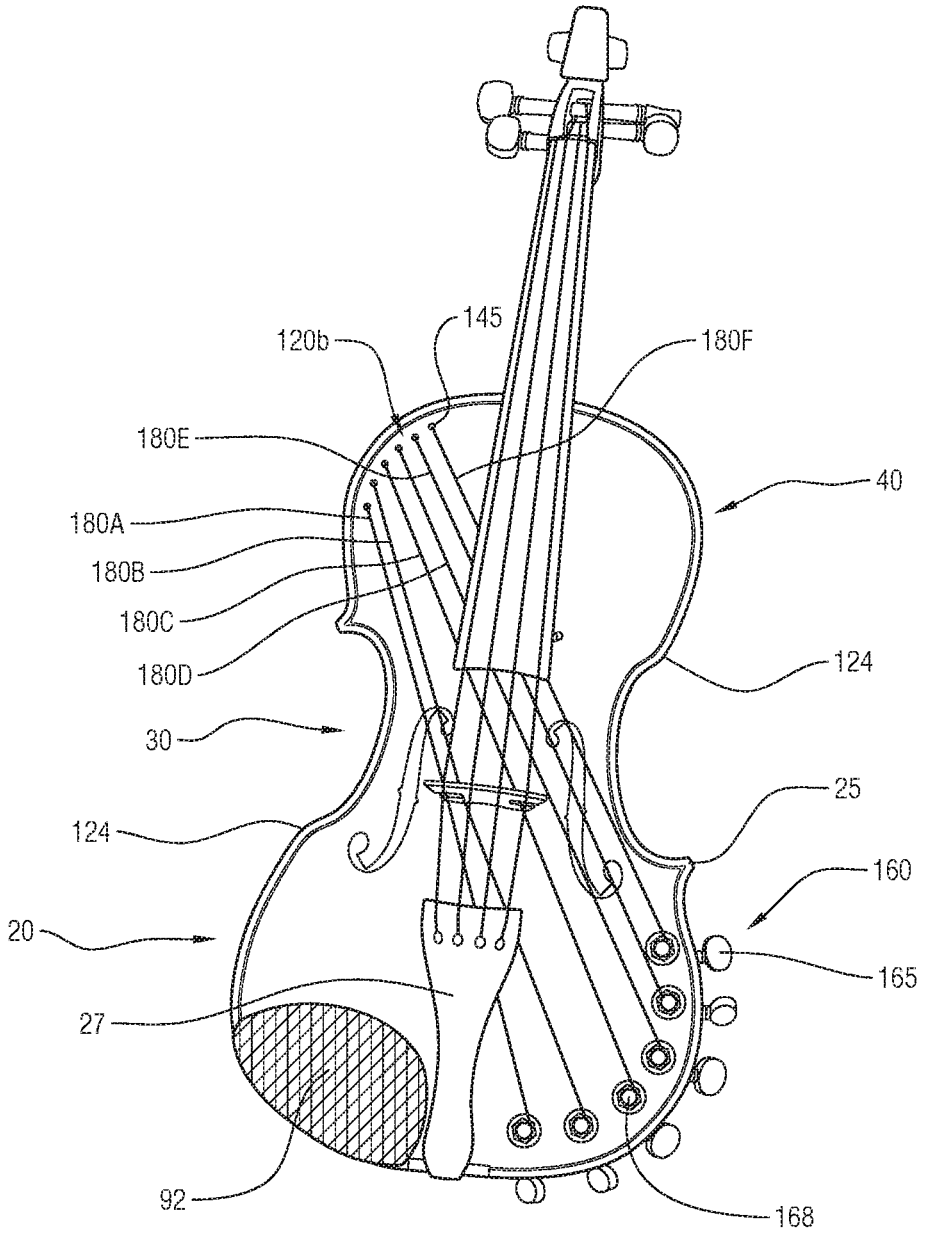
FIG. 9 is a front view of a third embodiment of the present invention, the violin variation of the bowed stringed instrument with sympathetic strings, which has tuners installed within an elongated aperture with only the tuner heads extending beyond the peripheral contour of the lower right bout.
Figure 10:
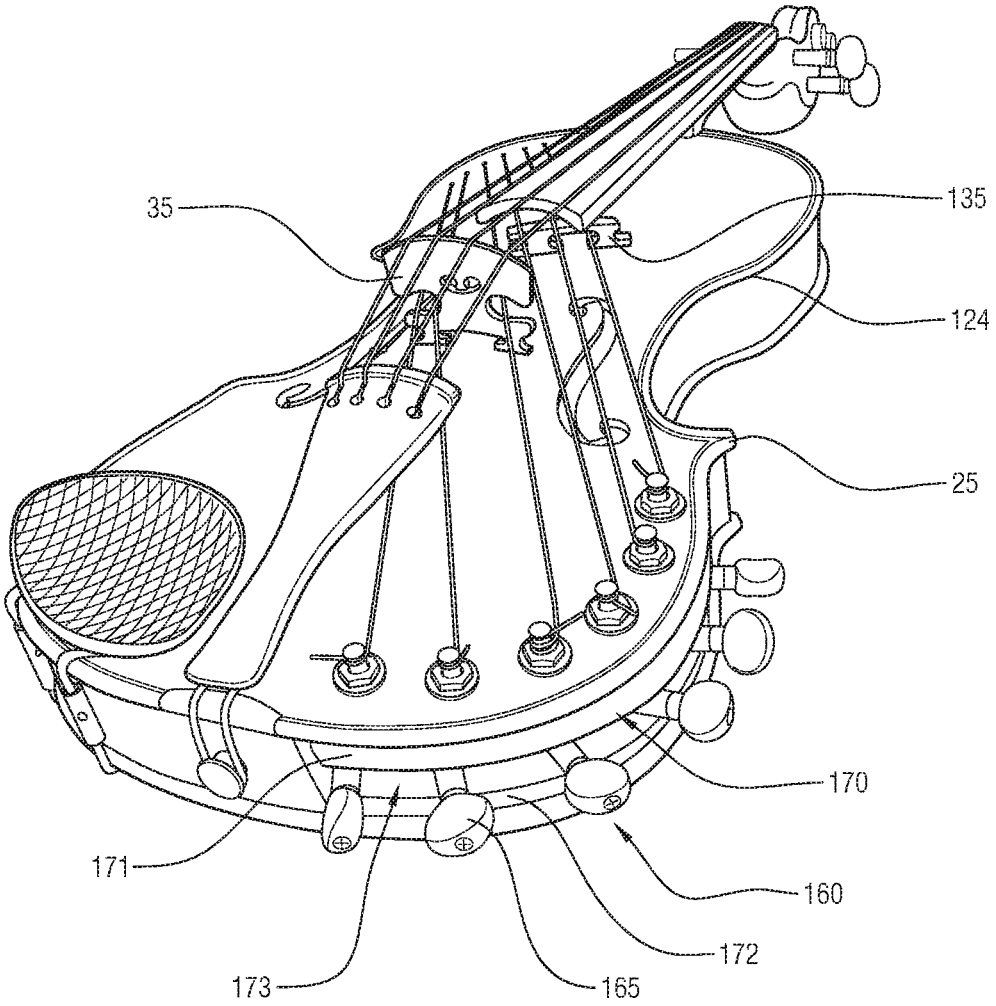

In another aspect of the invention, as seen in FIG. 9, there may be only one corner 25 on each half of the instrument. On the left half of the instrument, the conventional corner 25 between the top of the C-bout 30 and the upper bout 40 is traditionally used to pick up the instrument. On the right half of the instrument, the conventional corner 25 is disposed between the lower portion of the C-bout 30 and the upper portion of the lower bout 20 and is used by the player to rest the knee in an instrument placed on the floor to be played. In this aspect, the corner 25 that conventionally would be disposed between the C-bout and the right lower bout and the corner 25 that would conventionally be disposed between the C-bout and the left upper bout are eliminated with the introduction of a rounded corner 124. This optional design with one or two rounded corners 124 replacing the conventional angled corners may be preferred in some instances based on musical and aesthetic considerations, as determined by the designer of the instrument.

In another aspect of the invention, the inventive sympathetic string instrument includes a pickup 197 (FIG. 11) that captures or senses mechanical vibrations produced by the strings and that converts these vibrations to an electrical signal. The pickup 197 (part of which is typically internal) is connected with a patch cable to recording equipment or to an amplifier that amplifies the signal to a sufficient magnitude of power to drive a loudspeaker. The pickup 197 may be any conventional pickup, such as passive, active, piezo, contact microphone, or other types known in the art. The pickup 197 provides an advantage in direct line recording or studio quality performing over the standard stringed instrument, which tends to sound flat or dull without having effects added. With the sympathetic string instrument, the vibrations of the sympathetic strings inherently add a resonance and reverberation that is naturally occurring, and which is more tasteful and aesthetically pleasing than the reverberation effect adding during post-production. Thus, the use of a pickup with a recording direct line will require little or no editing, as opposed to the much greater amount of editing required by standard electric instruments.

In a further aspect the inventive sympathetic string instrument includes one or more lighting elements 149 (FIGS. 13, 15, 16) that adds visual interest to the instrument 100. The lighting element 149 has lights disposed within the interior cavity 34 (FIG. 15) that are visible by viewers of the front of the instrument. The lighting element 149 may be LED-type lights dispersed and spaced along an insulated electrical cord 148 (FIGS. 13, 15) or strand-type lights (FIG. 16), such as LED strands or fiber optic strands. The lighting element 149 may be battery powered, such as illustrated in FIG. 15 or may be powered from an electrical outlet, such as illustrated in FIG. 16.

When the one or more lighting elements 149 are powered by electricity, as in FIG. 16, an electrical cord 141 attached to a household electrical outlet is removably or fixedly attached to a connector element 142 to which the lighting element 149 is fixedly attached and through which the lighting element 149 receives electrical power.

When the one or more lighting elements 149 are powered by battery power, as in FIG. 15, a battery compartment 147 is fixedly disposed within the interior cavity 34, and the lighting element 149 is connected via a connection 146 leading to the battery installed within the battery compartment 147. The battery may be one or more replaceable standard batteries or rechargeable batteries. In another aspect, the battery may be a fixedly attached rechargeable battery. In this aspect, at least one connection is included to allow charging of the rechargeable battery from household electrical current.

The installation of one or more lighting elements 149 provides a means of visually enhancing the instrument. In one aspect, the light produced by the lighting element(s) 149 may be viewed through the f-holes 37. In another aspect, the face or soundboard is perforated with holes defined by hole edges 143. The perforated face 110 allows the light produced by the lighting element(s) 149 to be viewed through the holes defined by lighting hole edges 143. In a further aspect, the lighting element(s) 149 may extend slightly through the holes defined by hole edges 143. In another aspect the neck 50 may be perforated with holes defined by lighting hole edges 143.

In additional aspects as illustrated in FIG. 14, the inventive sympathetic string instrument includes a face 199 that is mirrored or that is formed of a video display screen. In the aspect in which the face 199 is mirrored, any or all of the lower bout 20, C-bout 30, or upper bout 40 may be covered in a mirror. The mirror may be a single piece of mirror (as illustrated in FIG. 14) or may be a composition mirror composed of multiple mirror pieces. In the aspect in which the face 199 is a video display screen, accessory components are disposed within the interior cavity 34 (FIG. 15) and power may be supplied by an external power source through power cord 141 (FIG. 16). The accessory components include display screen hardware and software components as are known in the art.

In another aspect as illustrated in FIG. 17, the inventive sympathetic string instrument includes a connector 132 for a fog machine (not shown). The fog machine connects to fog connector 132 and pumps fog into the internal cavity 34. The fog exits at least out the f-holes 37. The fog may also exit out lighting holes defined by lighting hole edges 143, other holes particularly designed to allow the escape of fog, or the perforated face/soundboard 110.

In a further aspect as illustrated in FIG. 18, the inventive sympathetic string instrument includes an access door 121 that allows a user to reach into the interior cavity 34. The access door 121 may provide advantages when batteries need to be replaced, lighting elements 149 need maintenance or replacing, a foreign object falls into the interior cavity 34 through an f-hole 37, and other such maintenance needs to be performed. The access door 121 may be disposed within the rib 95 and may include a hinge 123 and a latch 122 to secure the door 121 shut. The access door 121 has door edges 129 that abut the cutout rib edges 97 to give a finished look and to minimize awareness of the door by viewers of the instrument during performances.

An advantage of the design of the sympathetic string-enhanced instrument is that it is based on a standard instrument design (such as violin, viola, cello, or bass), which makes it easily and instantly playable by any player of that instrument. No new skills are needed, and navigating the instrument feels the same.

Another advantage of the design is that having the sympathetic strings diagonal on the soundboard 99 gives the instrument an eye-catching look, while also leaving the strings exposed and accessible. Having the sympathetic strings exposed makes it easy to pluck them for tuning purposes. The design also allows the bridges for the sympathetic strings be near the center of the string, giving each string the ability to make two separate pitches, doubling the sympathetic notes. Six strings can give twelve pitches, which covers the range of a semitone scale. All notes can be represented with few strings.

The sympathetic string-enhanced instrument is slightly heavier than a standard instrument due to the added weight of the tuners. However, in the case of instruments that are rested upon the ground to play, the weight is insignificant. In the case of handheld instruments like the violin and viola, the tuners are placed at the bottom of the body which places the additional weight near the shoulder. The instrument does not feel much heavier in the hand when in the playing position.

The addition of the sympathetic strings disposed diagonally across the soundboard 99 of the instrument assists both in projection of the musical sound and in an increase in resonance. The addition of sympathetic strings to an instrument will help the notes (particularly the low notes) reach further. Additionally, the positioning of the sympathetic strings diagonally presents an elegant, visually pleasing appearance without disrupting the overall look of the stringed instrument and provides advantages in aesthetics and in in facilitating storage and transport in available cases.

This inventive instrument 100 enhanced with sympathetic strings provides advantages over conventional instruments by broadening the repertoire of sounds and acoustics of the instrument. This provides benefits to both players and composers. The inventive instrument with sympathetic strings delivers both the standard sounds of the bowed strings and also provides a longer resonation than the standard bowed strings. It additionally enables the possibility of non-traditional plucking and strumming sounds.

The inventive enhanced instrument 100 may be made of the materials typically used in fabricating cello parts. For example, the body may typically be made of wood, aluminum (or other metal), or carbon fiber (or, less preferably, other synthetic materials, such as fiberglass or graphite fibers). In one aspect, the soundboard 99 is formed of spruce with maple used for the back, sides, and neck, though other woods are sometimes used, including laminated wood. In another aspect, the soundboard, back, sides, and neck are formed of carbon fiber. The material used for the strings 80, 180 may be gut, metal, or synthetic materials, for example, aluminum, chromium, titanium, sheep's gut, steel, or mixtures of metals, such as a steel-bronze mixture. The tailpiece(s) is traditionally made of ebony, but may be made of other woods, of metal, or of synthetic materials, such as plastic. The endpin is made of wood, metal, or synthetic materials, such as carbon fiber.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A stringed instrument, comprising:

a body comprising a back, rib, and a soundboard that together define a resonant cavity; said body comprising an upper bout, a lower bout, and a C-bout disposed between said upper bout and said lower bout; said upper bout comprising a left and a right upper bout; said lower bout comprising a left and a right lower bout;

a neck fixedly connected to said body and comprising primary tuners;

a primary tailpiece secured to said lower bout;

primary strings extending over said primary bridge, tunably attached to said primary tuners, and attached to said primary tailpiece;

a primary bridge disposed between said primary strings and said soundboard;

a set of supplementary tuners mounted to said left upper bout;

a supplementary string termination assembly secured to said right lower bout;

at least one supplementary bridge supported on said soundboard; and a set of sympathetic strings, with each of said set of supplementary strings extending over said at least one supplementary bridge, tunably attached to one of said set of supplementary tuners, and attached to said supplementary string termination assembly.

2. The stringed instrument as recited in claim 1, wherein:

said supplementary string termination assembly comprises multiple string-receiving holes defined by string-receiving hole edges disposed on said right lower bout; wherein each of said multiple string-receiving holes is configured to accommodate one of said set of sympathetic strings;

said supplementary string termination assembly further comprises at least one interior reinforcement; and each of said set of supplementary strings is tunably attached to one of said set of supplementary tuners, runs diagonally under said primary bridge and over said at least one supplementary bridge, into one of said multiple string-receiving holes defined by string-receiving hole edges, and attaches to said supplementary string termination assembly.

3. The stringed instrument as recited in claim 1, wherein said supplementary string termination assembly comprises at least one tailpiece.

4. The stringed instrument as recited in claim 1, wherein:

said left upper bout comprises a channel that follows the contour of said left upper bout outer edge; and each of said set of supplementary tuners is mounted at least partially within said channel.

5. The stringed instrument as recited in claim 4, wherein said channel comprises a generally U-shaped channel comprising a channel front formed by said soundboard, a channel bottom, and a channel back wall.

6. The stringed instrument as recited in claim 4, wherein:

each of said set of supplementary tuners comprises a gear box, a stem configured with a stem hole to receive one string of said set of sympathetic strings, and a head;

said soundboard is configured with stem-receiving holes defined by stem-receiving hole edges;

said each tuner stem extends through one of said stem-receiving holes; and said tuner gear box is disposed substantially within said channel.

7. The stringed instrument as recited in claim 1, wherein:

said left upper bout comprises an extension base fixedly attached to, and following the contour of, said left upper bout outer edge;

said extension base extends upwardly above said left upper bout outer edge; and each of said set of supplementary tuners is mounted to said extension base.

8. The stringed instrument as recited in claim 7, wherein:

said extension base comprises an L-shaped element including a first, front leg extending substantially vertically from said left upper bout outer edge and a second leg extending horizontally along said rib and fixedly attached to said rib.

9. The stringed instrument as recited in claim 7, wherein:

each of said set of supplementary tuners comprises a gear box, a stem configured with a stem hole to receive one string of said set of sympathetic strings, and a head;

said extension base is configured with stem-receiving holes defined by stem-receiving hole edges;

said each tuner stem extends through one of said stem-receiving holes; and said tuner gear box is disposed substantially behind said extension base.

10. The stringed instrument as recited in claim 1 further comprising a lighting element.

11. The stringed instrument as recited in claim 10, wherein said soundboard is perforated with holes defined by lighting hole edges that allow light from said lighting element to project outwardly.

12. A stringed instrument, comprising:

a body comprising a back, rib, and a soundboard that together define a resonant cavity; said body comprising an upper bout, a lower bout, and a C-bout disposed between said upper bout and said lower bout; said upper bout comprising a left and a right upper bout; said lower bout comprising a left and a right lower bout;

a neck fixedly connected to said body and comprising primary tuners;

a primary tailpiece secured to said lower bout;

primary strings extending over said primary bridge, tunably attached to said primary tuners, and attached to said primary tailpiece;

a primary bridge disposed between said primary strings and said soundboard;

a set of supplementary tuners mounted to said right lower bout;

a supplementary string termination assembly secured to said left upper bout;

at least one supplementary bridge supported by said soundboard; and a set of sympathetic strings, with each of said set of supplementary strings extending over said at least one supplementary bridge, tunably attached to one of said set of supplementary tuners, and attached to said supplementary string termination assembly.

13. The stringed instrument as recited in claim 12, wherein:

said supplementary string termination assembly comprises multiple string-receiving holes defined by string-receiving hole edges disposed on said right lower bout; wherein each of said multiple string-receiving holes is configured to accommodate one of said set of sympathetic strings;

said supplementary string termination assembly further comprises at least one interior reinforcement; and each of said set of supplementary strings is tunably attached to one of said set of supplementary tuners, runs diagonally under said primary bridge and over said at least one supplementary bridge, into one of said multiple string-receiving holes defined by string-receiving hole edges, and attaches to said supplementary string termination assembly.

14. The stringed instrument as recited in claim 12, wherein:

said right lower bout comprises a channel that follows the contour of said right lower bout outer edge; and each of said set of supplementary tuners is mounted partially within said channel.

15. The stringed instrument as recited in claim 14, wherein:

each of said set of supplementary tuners comprises a gear box, a stem configured with a stem hole to receive one string of said set of sympathetic strings, and a head;

said soundboard is configured with stem-receiving holes defined by stem-receiving hole edges;

said each tuner stem extends through one of said stem-receiving holes; and said tuner gear box is disposed substantially within said channel.

16. The stringed instrument as recited in claim 12, wherein:

said right lower bout comprises an extension base fixedly attached to, and following the contour of, said right lower bout outer edge;

said extension base extends above the surface of said soundboard; and each of said set of supplementary tuners is mounted to said extension base.

17. The stringed instrument as recited in claim 12 further comprising a lighting element.

18. The stringed instrument as recited in claim 12, wherein said soundboard is perforated with holes defined by lighting hole edges that allow light from said lighting element to project outwardly.

19. A stringed instrument, comprising:

a body comprising a back, rib, and a soundboard that together define a resonant cavity; said body comprising an upper bout, a lower bout, and a C-bout disposed between said upper bout and said lower bout; said upper bout comprising a left and a right upper bout; said lower bout comprising a left and a right lower bout;

a neck fixedly connected to said body and comprising primary tuners;

a primary tailpiece secured to said lower bout;

primary strings extending over said primary bridge, tunably attached to said primary tuners, and attached to said primary tailpiece;

a primary bridge disposed between said primary strings and said soundboard;

a set of supplementary tuners mounted to said left upper bout;

a supplementary string termination assembly secured to said right lower bout;

at least one supplementary bridge supported by said soundboard; and a set of sympathetic strings, with each of said set of supplementary strings extending over said at least one supplementary bridge, tunably attached to one of said set of supplementary tuners, and attached to said supplementary string termination assembly; and wherein:

said supplementary string termination assembly comprises multiple string-receiving holes defined by string-receiving hole edges disposed on said right lower bout; wherein each of said multiple string-receiving holes is configured to accommodate one of said set of sympathetic strings;

said supplementary string termination assembly further comprises at least one interior reinforcement;

each of said set of supplementary strings is tunably attached to one of said set of supplementary tuners, extends over said at least one supplementary bridge, into one of said multiple string-receiving holes defined by string-receiving hole edges, and attaches to said supplementary string termination assembly;

said left upper bout comprises a channel that follows the contour of said left upper bout outer edge;

each of said set of supplementary tuners is mounted at least partially within said channel; and said set of sympathetic strings runs diagonally under said primary strings from said left upper bout to said right lower bout.

20. The stringed instrument as recited in claim 19 further comprising a lighting element.

* * * * *